US011508277B2

(12) United States Patent
Wai et al.

(10) Patent No.: US 11,508,277 B2
(45) Date of Patent: Nov. 22, 2022

(54) DISPLAY DRIVING SYSTEM, DISPLAY MODULE, METHOD FOR DRIVING DISPLAY SCREEN, AND ELECTRONIC DEVICE

(71) Applicant: Huawei Technologies Co., Ltd., Shenzhen (CN)

(72) Inventors: Dustin Yuk Lun Wai, Shenzhen (CN); Chun Yen Liu, Dongguan (CN); Chiaching Chu, Shenzhen (CN); Xia Li, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/433,207

(22) PCT Filed: Feb. 19, 2020

(86) PCT No.: PCT/CN2020/075782
§ 371 (c)(1),
(2) Date: Aug. 23, 2021

(87) PCT Pub. No.: WO2020/169036
PCT Pub. Date: Aug. 27, 2020

(65) Prior Publication Data

US 2022/0122500 A1 Apr. 21, 2022

(30) Foreign Application Priority Data

Sep. 6, 2019 (CN) ..... 201910843928.9

(51) Int. Cl.
*G09G 3/00* (2006.01)
*G09G 3/3208* (2016.01)

(52) U.S. Cl.
CPC ..... *G09G 3/035* (2020.08); *G09G 3/3208* (2013.01); *G09G 2310/08* (2013.01); *G09G 2320/0626* (2013.01); *G09G 2330/021* (2013.01)

(58) Field of Classification Search
CPC .... G06F 1/1616; G06F 1/1618; G06F 1/1641; G06F 1/1652; G06F 1/1647;
(Continued)

(56) References Cited

U.S. PATENT DOCUMENTS 11,176,879 B2 * 11/2021 Cho ..... H01L 51/0097
2007/0222718 A1 9/2007 Takahara
(Continued)

FOREIGN PATENT DOCUMENTS

CN 105452981 A 3/2016
CN 105976759 A 9/2016
(Continued)

*Primary Examiner* — Koosha Sharifi-Tafreshi
(74) *Attorney, Agent, or Firm* — Conley Rose, P.C.

(57) ABSTRACT

An electronic device includes a display screen, where the display screen includes a first display region and a second display region, and a display driving system including a first emission (EM) signal output end configured to send a first EM signal to the display screen, where the display driving system further includes a second EM signal output end configured to send a second EM signal to the display screen, where the first EM signal controls the first display region to display an image in a first time period, and the second EM signal controls the second display region not to display an image in the first time period.

20 Claims, 21 Drawing Sheets

(58) Field of Classification Search
CPC ..... G06F 1/1649; G06F 1/165; G06F 1/1677; G06F 1/3265; H04M 1/0214; H04M 2250/16; H04M 1/0268; H04M 1/0216; H04M 1/0222; H04M 1/0218; H04M 1/022; G09G 2380/02; G09G 3/035; G09G 3/3208; G09G 3/3233; G09G 3/3258; G09G 3/3225; G09G 3/3266; G09G 3/3275; G09G 3/3283; G09G 3/3291; G09G 3/30; G09G 3/32; G09G 2330/021; G09G 2310/04; G09F 9/301; H01L 2251/5338
See application file for complete search history.

(56) References Cited

U.S. PATENT DOCUMENTS

| | | | | |
|---|---|---|---|---|
| 2010/0182332 | A1 | 7/2010 | Ozawa et al. | |
| 2015/0035777 | A1 | 2/2015 | Hirakata et al. | |
| 2018/0075808 | A1 | 3/2018 | Yamashita et al. | |
| 2018/0233091 | A1 | 8/2018 | Ma | |
| 2018/0329508 | A1 | 11/2018 | Klein et al. | |
| 2018/0342192 | A1* | 11/2018 | Lee | G09G 5/02 |
| 2018/0374425 | A1 | 12/2018 | Jeong et al. | |

FOREIGN PATENT DOCUMENTS

| | | | |
|---|---|---|---|
| CN | 107610653 | A | 1/2018 |
| CN | 108121094 | A | 6/2018 |
| CN | 109346009 | A | 2/2019 |
| CN | 109377952 | A | 2/2019 |
| JP | 2006243621 | A | 9/2006 |

* cited by examiner

DISPLAY DRIVING SYSTEM, DISPLAY MODULE, METHOD FOR DRIVING DISPLAY SCREEN, AND ELECTRONIC DEVICE

CROSS-REFERENCE TO RELATED APPLICATIONS

This application is a U.S. National Stage of International Patent Application No. PCT/CN2020/075782 filed on Feb. 19, 2020, which claims priority to Chinese Patent Application No. 201910843928.9 filed on Sep. 6, 2019 and International Patent Application No. PCT/CN2019/075980 filed on Feb. 23, 2019. All of the aforementioned applications are hereby incorporated by reference in their entireties.

TECHNICAL FIELD

This application relates to the field of terminal technologies, and in particular, to a display driving system, a display module, a method for driving a display screen, and an electronic device.

BACKGROUND

With fast development of electronic technologies, electronic devices such as intelligent terminals and tablet computers greatly change the ways people live and work. To meet various requirements of users for entertainment, office, video viewing, or web browsing, sizes of display screens of electronic devices are designed to be larger. In addition, to improve user experience, a same display screen may be split into a plurality of display regions, and the plurality of display regions on the same display screen may display different images or applications. For example, one display region is used to play back a video, and another display region may be used to present a chat interface, to meet various requirements of a user at the same time. Moreover, the plurality of display regions may also be combined to present a same image or video. For example, a foldable screen is a typical example of a display screen including a plurality of display regions. To achieve portability, a screen of an electronic device is designed as a foldable display screen. Based on different requirements, a user may fold the foldable display screen to form a relatively small display screen, or unfold the foldable display screen to form a relatively large display screen to implement functions such as web browsing and video viewing.

However, the display screen with a plurality of display regions also brings difficulties to a design of a display driving system. For example, as a size of the display screen becomes larger and a design of the display driving system becomes more complex, power consumption of the electronic device also increases. How to design a display driving system to reduce power consumption of an electronic device is an urgent problem to be resolved in the industry.

SUMMARY

This application provides a display driving system, a display module, a method for driving a display screen, and an electronic device to improve design flexibility of the display driving system.

According to a first aspect, an electronic device is provided, including: a display screen, where the display screen includes a first display region and a second display region; and a display driving system, including a first emission EM signal output end configured to send a first EM signal to the display screen, where the display driving system further includes a second EM signal output end configured to send a second EM signal to the display screen, where the first EM signal is used to control the first display region to display an image in a first time period, and the second EM signal is used to control the second display region not to display an image in the first time period.

In this embodiment of this application, different EM signals are used to independently control emitting and non-emitting states of pixel circuits in each of a plurality of display regions of the display screen, to provide an independent EM management function for each display region. Therefore, when a display region does not display an image, an EM signal may be used to control the display region not to display an image, and there is no need to always output a video source signal indicating a black screen. This improves design flexibility of the display driving system, and makes it possible to reduce power consumption of a display screen drive circuit.

With reference to the first aspect, in a possible implementation, the first EM signal remains at a first level or transitions between the first level and a second level in the first time period, and the second EM signal remains at the second level in the first time period; when the first EM signal is at the first level, the first display region is controlled to emit light, or when the first EM signal is at the second level, the first display region is controlled not to emit light; and when the second EM signal is at the first level, the second display region is controlled to emit light, or when the second EM signal is at the second level, the second display region is controlled not to emit light.

As an example, the first EM signal may be a pulse width modulation (pulse width modulation, PWM) signal in the first time period.

With reference to the first aspect, in a possible implementation, the display driving system further includes a video source output end configured to: output a video source signal corresponding to the first display region in a first time interval in a first time frame, and turn off a video source signal corresponding to the second display region in a second time interval in the first time frame, where the first time frame belongs to the first time period.

In this embodiment of this application, in a time period in which one of the plurality of display regions does not display an image, the display driving system may turn off a video source signal corresponding to the display region in a corresponding partial time interval in each time frame, thereby reducing power consumption of the display driving system.

With reference to the first aspect, in a possible implementation, the display driving system further includes a video source output end configured to: output, in the first time interval in a second time frame, a video source signal corresponding to the first display region and indicating a black screen, where the second time frame is adjacent to a third time frame and is located before the third time frame, and the first EM signal is further used to control the first display region to switch from displaying an image to not displaying an image, starting from the third time frame.

In this embodiment of this application, to avoid erratic display in a process of switching a display region between a display state and a non-display state, before the state switching, the display driving system may first instruct, by using a video source signal, the display region to display a black screen, and then switch to an image display state or a non image display state, so that a phenomenon of erratic display can be avoided, and that user experience can be improved.

With reference to the first aspect, in a possible implementation, the display driving system further includes a video source output end configured to: output, in the first time interval in a fourth time frame, a video source signal corresponding to the first display region and indicating a black screen, where the fourth time frame is adjacent to a fifth time frame and is located before the fifth time frame, and the first EM signal is further used to control the first display region to switch from not displaying an image to displaying an image, starting from the fourth time frame.

In this embodiment of this application, to avoid erratic display in a process of switching a display region between a display state and a non-display state, before the state switching, the display driving system may first instruct, by using a video source signal, the display region to display a black screen, and then switch to an image display state or a non image display state, so that a phenomenon of erratic display can be avoided, and that user experience can be improved.

With reference to the first aspect, in a possible implementation, the video source signal corresponding to the first display region and the video source signal corresponding to the second display region are generated based on different brightness calibration parameters.

In this embodiment of this application, different brightness calibration parameters may be used to generate video source signals of different display regions. Therefore, brightness of different display regions may be different, design flexibility of the display driving system is improved, and user experience is improved.

With reference to the first aspect, in a possible implementation, the brightness calibration parameter includes a display brightness vector DBV.

With reference to the first aspect, in a possible implementation, the display driving system further includes: a first emission layer positive voltage ELVDD output end, configured to output a first ELVDD, where the first ELVDD is used to provide a high supply voltage for a pixel circuit in the first display region; and a second ELVDD output end, configured to output a second ELVDD, where the second ELVDD is used to provide a high supply voltage for a pixel circuit in the second display region, and voltage values of the first ELVDD and the second ELVDD are different.

In this embodiment of this application, the display driving system may provide an independent supply voltage signal for each of the plurality of display regions, thereby facilitating independent management of supply voltages of different display regions, and improving design flexibility of the display driving system.

With reference to the first aspect, in a possible implementation, the display driving system further includes: a first emission layer negative voltage ELVSS output end configured to output a first ELVSS, where the first ELVSS is used to provide a low supply voltage for the pixel circuit in the first display region; and a second ELVSS output end, configured to output a second ELVSS, where the second ELVSS is used to provide a low supply voltage for the pixel circuit in the second display region, and voltage values of the first ELVSS and the second ELVSS are different.

In this embodiment of this application, the display driving system may provide an independent supply voltage signal for each of the plurality of display regions, thereby facilitating independent management of supply voltages of different display regions, and improving design flexibility of the display driving system.

With reference to the first aspect, in a possible implementation, the display driving system includes a first display drive circuit and a second display drive circuit, where the first display drive circuit includes the first EM signal output end, and the second display drive circuit includes the second EM signal output end.

With reference to the first aspect, in a possible implementation, the display driving system includes a first display drive circuit, and the first display drive circuit includes the first EM signal output end and the second EM signal output end.

With reference to the first aspect, in a possible implementation, the display screen includes a foldable display screen.

According to a second aspect, a display driving system for controlling a display screen is provided, where the display screen includes a first display region and a second display region, and the display driving system includes: a first emission EM signal output end, configured to send a first EM signal to the display screen; and a second EM signal output end, configured to send a second EM signal to the display screen, where the first EM signal is used to control the first display region to display an image in a first time period, and the second EM signal is used to control the second display region not to display an image in the first time period.

It should be understood that the display driving system in the second aspect and the electronic device in the first aspect are based on a same inventive concept. Therefore, for beneficial technical effects that can be achieved by the technical solution in the third aspect, refer to the description in the first aspect. Details are not described again.

With reference to the second aspect, in a possible implementation, the first EM signal remains at a first level or transitions between the first level and a second level in the first time period, and the second EM signal remains at the second level in the first time period; when the first EM signal is at the first level, the first display region is controlled to emit light, or when the first EM signal is at the second level, the first display region is controlled not to emit light; and when the second EM signal is at the first level, the second display region is controlled to emit light, or when the second EM signal is at the second level, the second display region is controlled not to emit light.

As an example, the first EM signal may be a PWM signal in the first time period.

With reference to the second aspect, in a possible implementation, the display driving system further includes a video source output end configured to: output a video source signal corresponding to the first display region in a first time interval in a first time frame, and turn off a video source signal corresponding to the second display region in a second time interval in the first time frame, where the first time frame belongs to the first time period.

With reference to the second aspect, in a possible implementation, the display driving system further includes a video source output end configured to: output, in the first time interval in a second time frame, a video source signal corresponding to the first display region and indicating a black screen, where the second time frame is adjacent to a third time frame and is located before the third time frame, and the first EM signal is further used to control the first display region to switch from displaying an image to not displaying an image, starting from the third time frame.

With reference to the second aspect, in a possible implementation, the display driving system further includes a video source output end configured to: output, in the first time interval in a fourth time frame, a video source signal corresponding to the first display region and indicating a black screen, where the fourth time frame is adjacent to a fifth time frame and is located before the fifth time frame, and the first EM signal is further used to control the first display region to switch from not displaying an image to displaying an image, starting from the fourth time frame.

With reference to the second aspect, in a possible implementation, the video source signal corresponding to the first display region and the video source signal corresponding to the second display region are generated based on different brightness calibration parameters.

With reference to the second aspect, in a possible implementation, the brightness calibration parameter includes a display brightness vector DBV.

With reference to the second aspect, in a possible implementation, the display driving system further includes: a first emission layer positive voltage ELVDD output end, configured to output a first ELVDD, where the first ELVDD is used to provide a high supply voltage for a pixel circuit in the first display region; and a second ELVDD output end, configured to output a second ELVDD, where the second ELVDD is used to provide a high supply voltage for a pixel circuit in the second display region, and voltage values of the first ELVDD and the second ELVDD are different.

With reference to the second aspect, in a possible implementation, the display driving system further includes: a first emission layer negative voltage ELVSS output end, configured to output a first ELVSS, where the first ELVSS is used to provide a low supply voltage for the pixel circuit in the first display region; and a second ELVSS output end, configured to output a second ELVSS, where the second ELVSS is used to provide a low supply voltage for the pixel circuit in the second display region, and voltage values of the first ELVSS and the second ELVSS are different.

With reference to the second aspect, in a possible implementation, the display driving system includes a first display drive circuit and a second display drive circuit, where the first display drive circuit includes the first EM signal output end, and the second display drive circuit includes the second EM signal output end.

With reference to the second aspect, in a possible implementation, the display driving system includes a first display drive circuit, and the first display drive circuit includes the first EM signal output end and the second EM signal output end.

With reference to the second aspect, in a possible implementation, the display screen includes a foldable display screen.

According to a third aspect, a method for driving a display screen is provided, where the display screen includes a first display region and a second display region, and the method includes: sending a first emission EM signal to the display screen; and sending a second EM signal to the display screen, where the first EM signal is used to control the first display region to display an image in a first time period, and the second EM signal is used to control the second display region not to display an image in the first time period.

It should be understood that the method for driving a display screen in the third aspect and the electronic device in the first aspect are based on a same inventive concept. Therefore, for beneficial technical effects that can be achieved by the technical solution in the third aspect, refer to the description in the first aspect. Details are not described again.

With reference to the third aspect, in a possible implementation, the first EM signal remains at a first level or transitions between the first level and a second level in the first time period, and the second EM signal remains at the second level in the first time period; when the first EM signal is at the first level, the first display region is controlled to emit light, or when the first EM signal is at the second level, the first display region is controlled not to emit light; and when the second EM signal is al the first level, the second display region is controlled to emit light, or when the second EM signal is at the second level, the second display region is controlled not to emit light.

As an example, the first EM signal may be a PWM signal in the first time period.

With reference to the third aspect, in a possible implementation, the method further includes: outputting, to the display screen, a video source signal corresponding to the first display region in a first time interval in a first time frame, and turning off a video source signal corresponding to the second display region in a second time interval in the first time frame, where the first time frame belongs to the first time period.

With reference to the third aspect, in a possible implementation, the method further includes: outputting, to the display screen in a first time interval in a second time frame, a video source signal corresponding to the first display region and indicating a black screen, where the second time frame is adjacent to a third time frame and is located before the third time frame, and the first EM signal is further used to control the first display region to switch from displaying an image to not displaying an image, starting from the third time frame.

With reference to the third aspect, in a possible implementation, the method further includes: outputting, to the display screen in a first time interval in a fourth time frame, a video source signal corresponding to the first display region and indicating a black screen, where the fourth time frame is adjacent to a fifth time frame and is located before the fifth time frame, and the first EM signal is further used to control the first display region to switch from not displaying an image to displaying an image, starting from the fourth time frame.

With reference to the third aspect, in a possible implementation, the video source signal corresponding to the first display region and the video source signal corresponding to the second display region are generated based on different brightness calibration parameters.

With reference to the third aspect, in a possible implementation, the brightness calibration parameter includes a display brightness vector DBV.

With reference to the third aspect, in a possible implementation, the method further includes: outputting a first ELVDD to the display screen, where the first ELVDD is used to provide a high supply voltage for a pixel circuit in the first display region; and outputting a second ELVDD to the display screen, where the second ELVDD is used to provide a high supply voltage for a pixel circuit in the second display region, and voltage values of the first ELVDD and the second ELVDD are different.

With reference to the third aspect, in a possible implementation, the method further includes: outputting a first ELVSS to the display screen, where the first ELVSS is used to provide a low supply voltage for the pixel circuit in the first display region; and outputting a second ELVSS to the display screen, where the second ELVSS is used to provide a low supply voltage for the pixel circuit in the second display region, and voltage values of the first ELVSS and the second ELVSS are different.

With reference to the third aspect, in a possible implementation, the display screen includes a foldable display screen.

According to a fourth aspect, a chip is provided, including a processor. The processor is configured to read and execute a computer program stored in a memory, to perform the method according to any one of the third aspect or the possible implementations of the third aspect.

According to a fifth aspect, a computer program product is provided, where the computer program product includes computer program code, and when the computer program code is run on a computer, the computer is enabled to perform the method according to any one of the third aspect or the possible implementations of the third aspect.

According to a sixth aspect, this application provides a computer readable storage medium, where the computer readable storage medium stores a computer instruction, and when the computer instruction is run on a computer, the computer is enabled to perform the method according to any one of the third aspect or the possible implementations of the third aspect.

According to a seventh aspect, this application provides a display module, where the display module includes a display screen and the display driving system according to any one of the second aspect or the possible implementations of the second aspect.

DESCRIPTION OF EMBODIMENTS

The following describes technical solutions of this application with reference to accompanying drawings.

Embodiments of this application provide a display driving system, a method for driving a display screen, and an electronic device. The display screen and the display driving system may be installed in the electronic device.

The electronic device in the embodiments of this application may include any electronic device including a display screen, such as user equipment, a mobile terminal, a smartphone, or a tablet computer (pad). This is not limited in the embodiments of this application.

Figure 1:
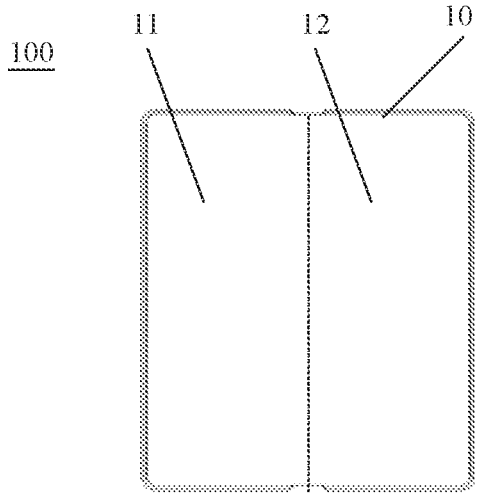
FIG. 1 is a schematic diagram of an electronic device in an unfolded state according to an embodiment of this application.
Figure 2:
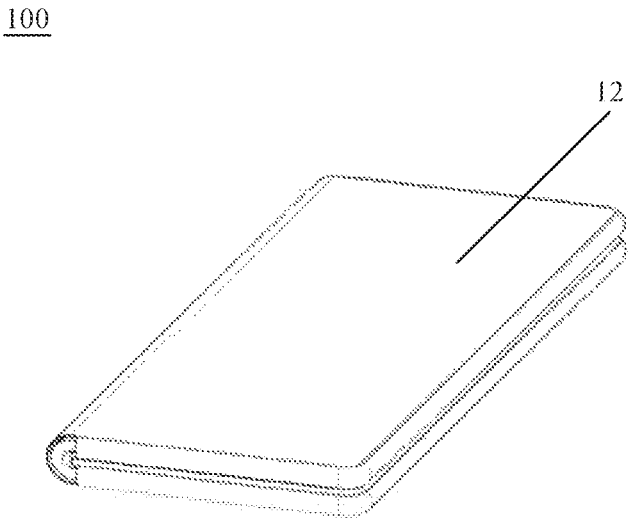
FIG. 2 is a schematic diagram of an electronic device in a folded state according to an embodiment of this application.

The display screen in this application may include a foldable display screen, or may include a non-foldable display screen. With reference to FIG. 1 and FIG. 2, the following describes an appearance of an electronic device in an embodiment of this application by using a foldable display screen as an example.

FIG. 1 and FIG. 2 are schematic diagrams of an appearance of an electronic device 100 according to an embodiment of this application. The electronic device 100 in FIG. 1 is in an unfolded state, and the electronic device 100 in FIG. 2 is in a folded state. As shown in FIG. 1, a display screen 10 of the electronic device 100 includes a first display region 11 and a second display region 12. The first display region 11 may be folded relative to the second display region 12, where a dashed line shows a dividing line between the first display region 11 and the second display region 12. In FIG. 1, when the display screen 10 is in the unfolded state, both the first display region 11 and the second display region 12 may be used to display an image. Optionally, the display screen 10 may be implemented by using a flexible screen.

The flexible screen may include, for example, a structure such as an organic light-emitting diode (organic light-emitting diode, OLED) display screen. This is not limited in this embodiment of this application.

As shown in FIG. 2, when the display screen is in the folded state, the first display region 11 and the second display region 12 are folded back to back. If a user faces the first display region 11, the first display region 11 may display an image, and the second display region 12 does not display an image. Alternatively, if a user faces the second display region 12, the first display region 11 does not display an image, and the second display region 12 displays an image.

It should be understood that the electronic device 100 in FIG. 1 and FIG. 2 is merely used as an example. The appearance of the electronic device is not limited in this embodiment of this application, provided that the display screen of the electronic device includes two or more display regions. In this application, an example in which two display regions (11 and 12) are included is used to describe a display driving system and a method for driving a display screen. A person skilled in the art can understand that the solution in this embodiment of this application is also applicable to an electronic device including more than two display regions. For brevity, details are not described in this embodiment of this application.

Figure 3:
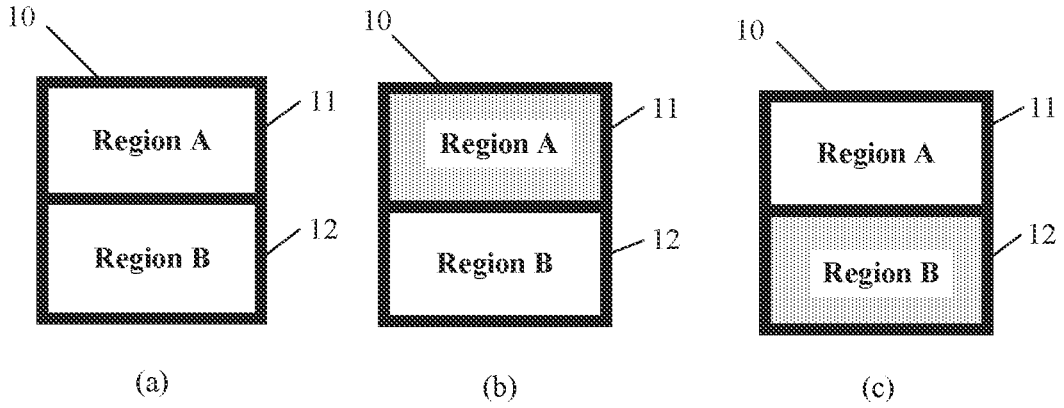
FIG. 3 is a schematic diagram of a display screen in a display state according to an embodiment of this application.

FIG. 3 is a schematic diagram of a display screen in a display state according to an embodiment of this application. As shown in FIG. 3, the display screen 10 may include a first display region 11 and a second display region 12. The first display region 11 and the second display region 12 may also be referred to as a first subscreen and a second subscreen respectively. For ease of description, in this embodiment of this application, the first display region 11 may be identified as a region A, and the second display region 12 may be identified as a region B. In some examples, the first display region 11 and the second display region 12 may be referred to as a front screen and a back screen respectively.

Optionally, as shown in (a) to (c) in FIG. 3, the foldable display screen includes three display states. Ina first working state (FIG. a), both the region A and the region B display an image. For example, assuming that the display screen is a foldable screen, when the foldable screen is in an unfolded state, both the region A and the region B may be used to display an image.

In a second working state (FIG. b), the region A does not display an image, and the region B displays an image. For example, assuming that the display screen is a foldable screen, when the display screen is in a folded state, the region B faces toward a user, and the region A faces away from the user. In this case, the region B may be used to display an image, but the region A does not display an image.

In a third display state (FIG. c), the display screen is in a folded state, the region A displays an image, and the region B does not display an image. For example, assuming that the display screen is a foldable screen, when the display screen is in the folded state, the region A faces toward the user, and the region B faces away from the user. In this case, the region A may display an image, but the region B does not display an image.

Figure 4:
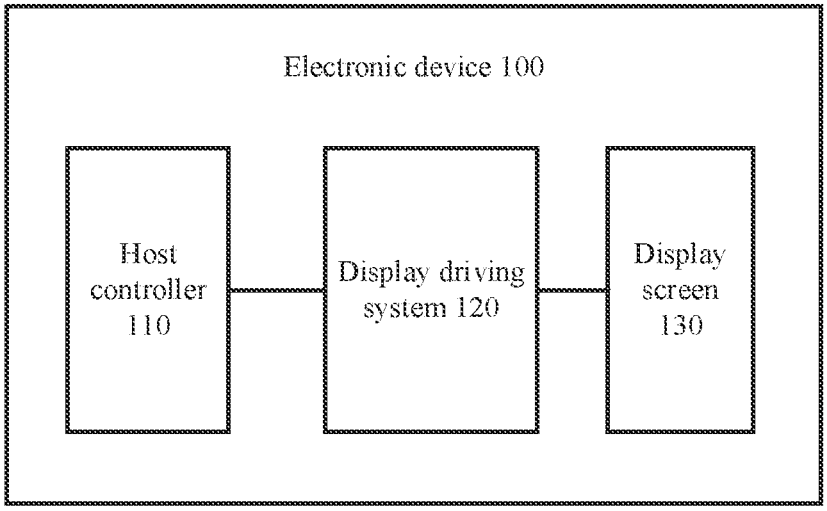
FIG. 4 is a schematic structural diagram of an electronic device according to an embodiment of this application.

FIG. 4 is a schematic structural diagram of an electronic device according to another embodiment of this application. As shown in FIG. 4, the electronic device 100 includes a host controller 110, a display driving system 120, and a display screen 130. The host controller 110 is connected to the display driving system 120. For ease of description, the following describes definitions of the modules or terms used in FIG. 4.

The host controller 110 is configured to output video data, a clock signal, and/or a host command to the display driving system 120. The host controller includes but is not limited to various types of processors such as a system-on-chip (system on chip, SOC), an application processor (application processor, AP), or a general-purpose processor.

The display driving system 120 is configured to receive the video data sent by the host controller 110, and obtain a video source signal after performing digital processing and analog processing on the video data by using a video processing module. The video source signal is output to the display screen 130, to drive the display screen 130 to display an image. In addition, the display driving system 120 may perform EM control management, GOA control management, and power management on the display screen 130, and output an emission (emission, EM) signal, an emission layer positive voltage (emission layer VDD, ELVDD), an emission layer negative voltage (emission layer VSS, ELVSS), a GOA signal, and the like to the display screen. In this embodiment of this application, the video source signal may also be referred to as a source signal.

Display drive circuit: The display driving system 120 may include one or more display drive circuits, and each display circuit may be a display drive hardware module. When the display driving system 120 includes a plurality of display drive circuits, an interface may exist between the plurality of display drive circuits to facilitate synchronization or interaction. In an example, the display drive circuit may also be referred to as a display driver integrated circuit (display driver integrated circuit, DDIC).

A pixel circuit is a minimum circuit unit in the display screen. One pixel circuit is equivalent to one subpixel (or referred to as a subpixel) in a display screen circuit, and the display screen includes a plurality of rows of subpixels. Based on a structure of the pixel circuit, subpixels in the display screen are scanned and emit light row by row. Therefore, when an image is displayed, after subpixels in a first row emit light, an emitting state needs to be maintained until subpixels in a last row emit light, so that the image can be displayed.

A gate driver on array (gate driver on array, GOA) is configured to provide a gating signal for each row of pixel circuits, to control turn-on or turn-off of each row of pixel circuits. In this embodiment of this application, the gate driver on array may also be referred to as a gate array.

For ease of understanding the solutions of this application, the following describes a structure and an operating principle of a pixel circuit in a display screen in the embodiments of this application with reference to the accompanying drawings. It should be noted that the following description is merely used as an example of the pixel circuit but is not intended to limit the protection scope of this application. Solutions or variations thereof obtained by a person skilled in the art according to the solutions of this application without creative efforts also fall within the protection scope of this application.

Figure 5:
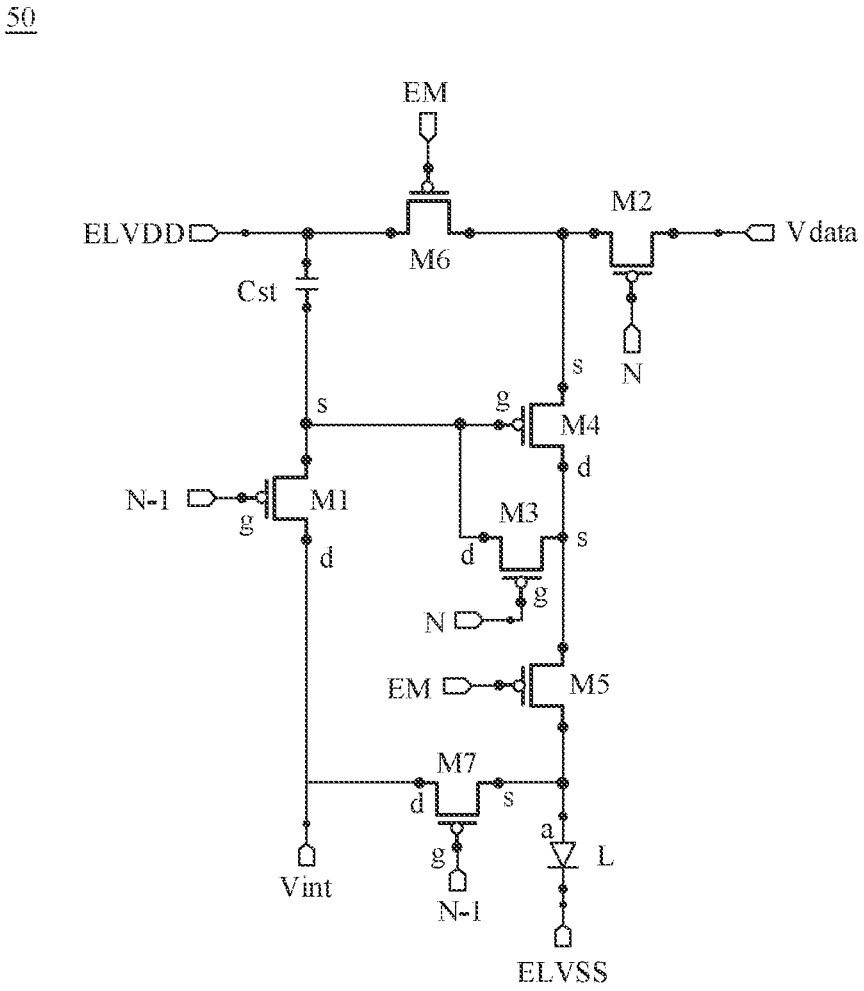
FIG. 5 is a schematic circuit diagram of a pixel circuit according to an embodiment of this application.

FIG. 5 is a schematic circuit diagram of a pixel circuit according to an embodiment of this application. As shown in FIG. 5, the pixel circuit 50 may include a capacitor Cst, an emitting device L, and a plurality of transistors (M1, M2, M3, M4, M5, M6, and M7). For ease of description, the transistor M1 is referred to as a first reset transistor, the transistor M7 is referred to as a second reset transistor, the transistor M4 is referred to as a drive transistor, the transistor M6 is referred to as a first emission control transistor, and the transistor M5 is referred to as a second emission control transistor. It should be noted that this is merely an example of a pixel circuit, and other designs may be used for the pixel circuit, for example, a 2T1C circuit including only two transistors and one capacitor, a 4T1C circuit including four transistors and one capacitor, and a 5T2C circuit including five transistors and two capacitors. In designs of these pixel circuits, turn-on and turn-off of a transistor connected in series to the emitting device may be controlled by using an EM signal, to control emission of the emitting device. This is not limited in this embodiment of this application.

It should be noted that the emitting device L may be an organic light emitting diode (organic light emitting diode, OLED). In this case, the display screen is an OLED display screen. Alternatively, the emitting device L may be a micro light emitting diode (mirco light emitting diode, mirco LED). In this case, the display screen is a mirco LED display screen. For ease of description, it is assumed that the emitting device L is an OLED in the following description.

Figure 6:
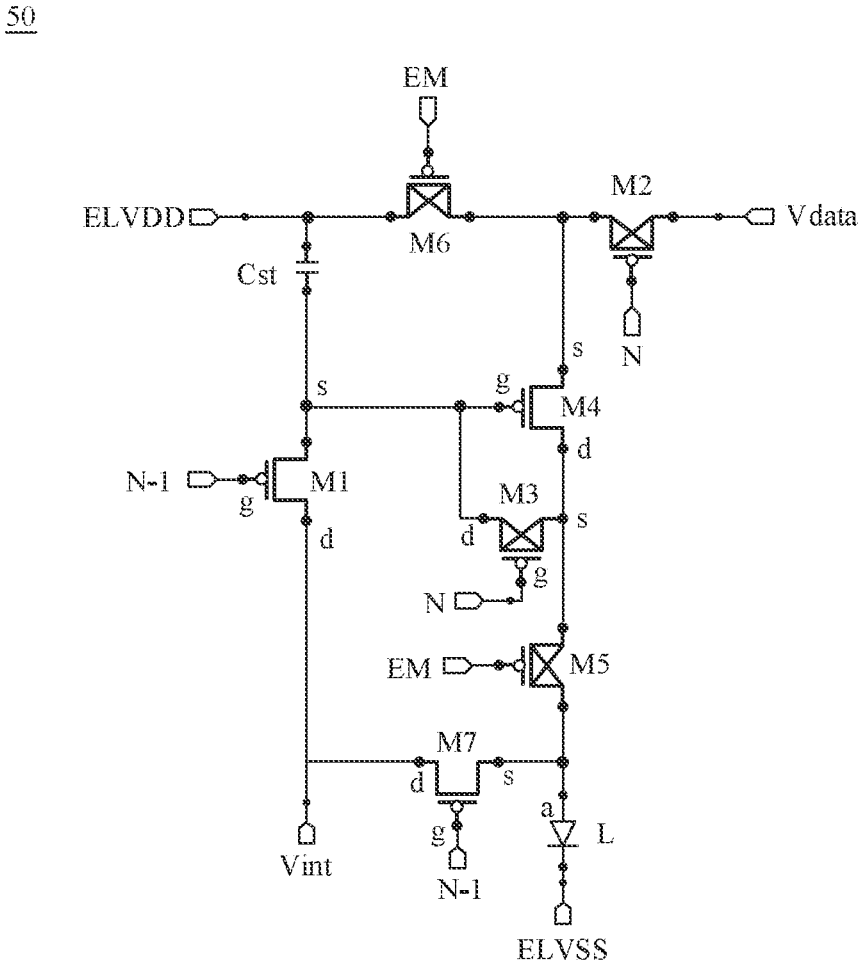
FIG. 6 is a schematic circuit diagram of a pixel circuit in a reset stage according to an embodiment of this application.
Figure 7:
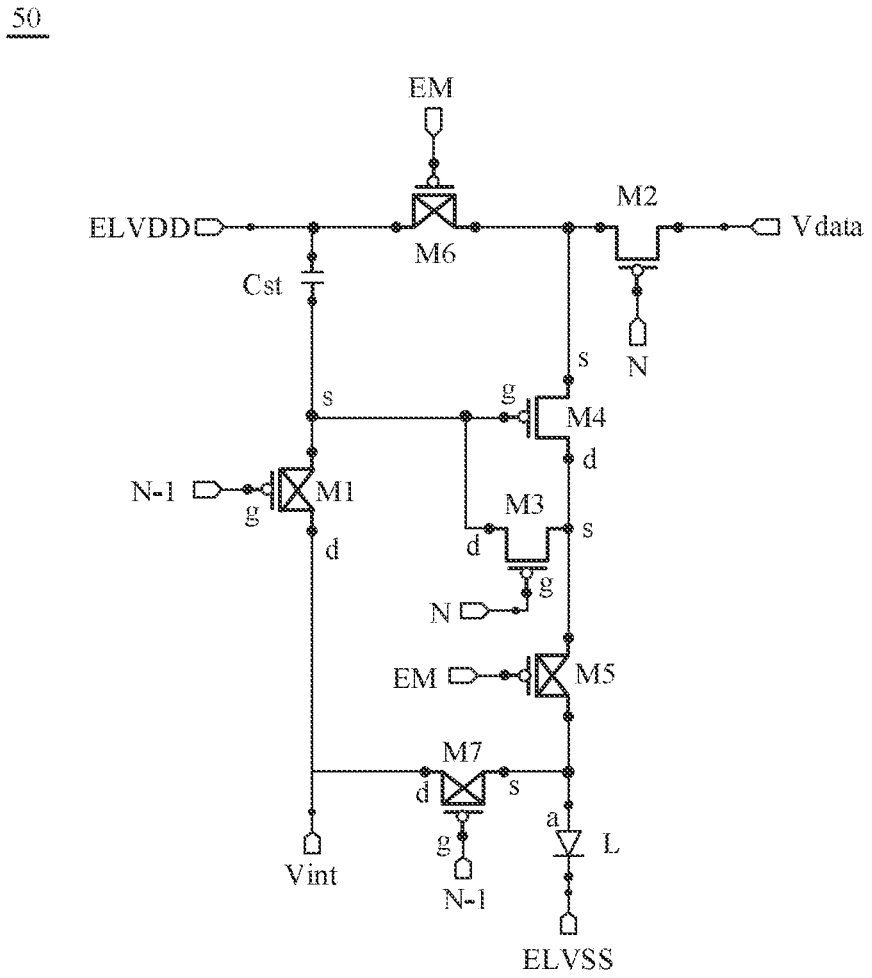
FIG. 7 is a schematic circuit diagram of a pixel circuit in a data voltage Vdata writing stage according to an embodiment of this application.
Figure 8:
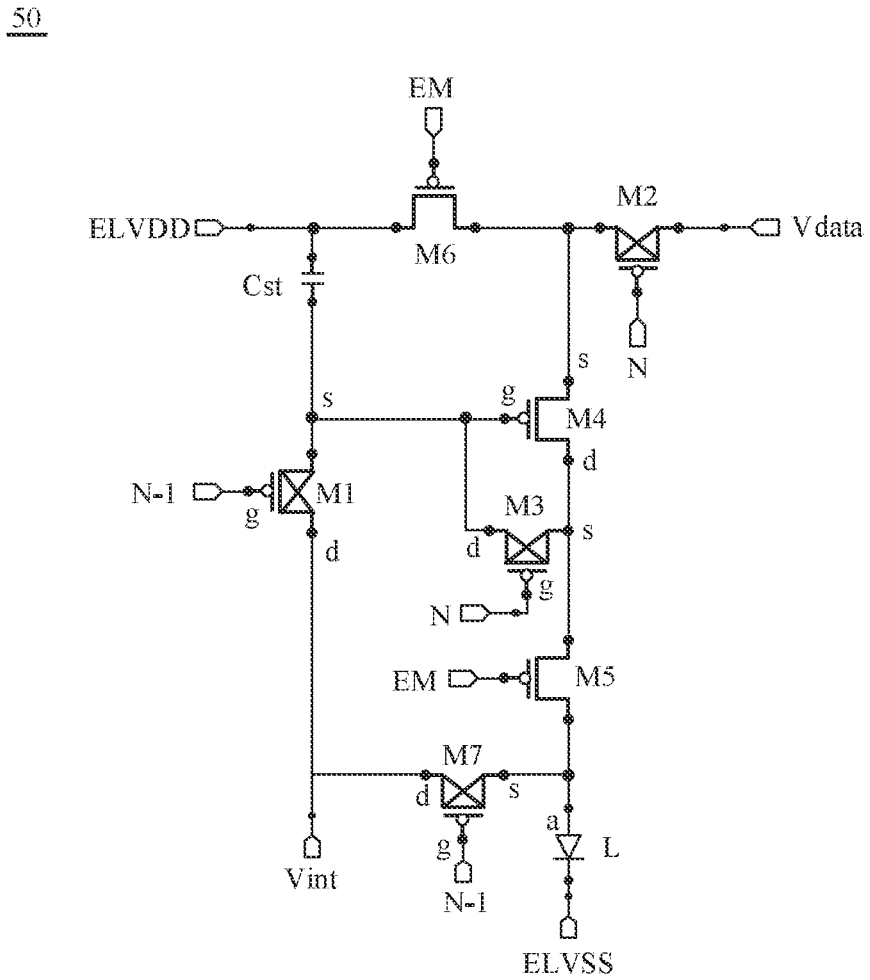
FIG. 8 is a schematic circuit diagram of a pixel circuit in an emission stage according to an embodiment of this application.

Based on a structure of the pixel circuit 50 shown in FIG. 5, a working process of the pixel circuit 50 includes three stages shown in FIG. 6 to FIG. 8: a first stage ①, a second stage ②, and a third stage ③. For ease of description and differentiation, in FIG. 6, FIG. 7, and FIG. 8, a mark "x" is added to a transistor that is turned off.

In the first stage ①, the first reset transistor M1 and the second reset transistor M7 are turned on under control of a gating signal N−1, as shown in FIG. 6. An initial voltage Vint is transmitted to a gate electrode of the drive transistor M4 through the first reset transistor M1 to reset the gate electrode of the drive transistor M4. In addition, the initial voltage Vint is transmitted to an anode (anode, a) of the OLED through the second reset transistor M7 to reset the anode a of the OLED. In this case, a voltage Va of the anode a of the OLED and a voltage Vg4 of the gate electrode g of the drive transistor M4 are Vint.

In this way, the voltages of the gate electrode g of the drive transistor M4 and the anode a of the OLED can be reset to the initial voltage Vint in the first stage ①, and residual voltages of the gate electrode g of the drive transistor M4 and the anode a of the OLED in a previous image are prevented from affecting a next image. Therefore, the first stage ① may be referred to as a reset stage.

In the second stage ②, the transistor M2 and the transistor M3 are turned on under control of a gating signal N, as shown in FIG. 7. When the transistor M3 is turned on, the gate electrode g of the drive transistor M4 is coupled to a drain electrode (drain, d), and the drive transistor M4 is in a diode on state. In this case, a data voltage Vdata is written to a source electrode s of the drive transistor M4 through the transistor M2 that is tuned on. Therefore, the second stage ② may be referred to as a data voltage Vdata writing stage of the pixel circuit.

In the third stage ③, the second emission control transistor M5 and the first emission control transistor M6 are turned on under control of an emission control signal EM, and a current path between a high supply voltage ELVDD and a low supply voltage ELVES is available. A drive current I generated by the drive transistor M4 is transmitted to the OLED through the current path, to drive the OLED to emit light.

Because the OLED emits light in the third stage ③, the third stage ③ may be referred to as an emission stage. It can be learned from the description of the third stage ③ that the EM signal may control the pixel circuit to be in an emitting state or a non-emitting state.

It should be noted that Vdata may be understood as a voltage signal corresponding to the pixel circuit, in a video source signal output by the display driving system 120 to the display screen. Each pixel circuit corresponds to different Vdata, and the Vdata may be used to control a value of the drive current I, to control luminous intensity of the pixel circuit. For example, depending on designs of some pixel circuits, the drive current $I \propto (ELVDD-Vdata)^2$. Certainly, this is only an example. Based on different designs of the pixel circuits, the drive current I and Vdata may satisfy other functional relationships. It should be noted that when the display screen is in a black screen state, the emitting device L does not emit light. However, due to the structure and a design principle of the pixel circuit, the pixel circuit still needs to receive the Vdata signal, and a voltage value of the Vdata signal should be set so that the drive current I is as close to zero as possible, and the emitting device L does not emit light. In some examples, in the black screen state, the voltage of the Vdata may be set to be higher than the voltage of the ELVDD, for example, Vdata=5.3 V and ELVDD=4.6 V.

It can be learned from the foregoing description that even if the display screen is in the black screen state, the display driving system 120 always needs to output a video source signal (that is, Vdata) to the display screen. Therefore, the display driving system 120 further needs to generate the video source signal. This obviously increases power consumption of the display driving system 120.

In a time frame in which the display screen displays each image, the display driving system 120 outputs a video source signal corresponding to the first display region in a first time interval in the time frame, and outputs a video source signal corresponding to the second display region in a second time interval in the time frame. For example, when the first display region of the display screen displays an image but the second display region does not display an image, the display driving system 120 further needs to output, in a second time interval in each time frame, a video source signal indicating a black screen, so that the second display region remains in a state of not displaying an image, and this increases power consumption of the display driving system 120.

If the video source signal is directly turned off in the second time interval in each time frame to reduce power consumption, because EM signals of the first display region and the second display region are the same, the EM signal still controls the second emission control transistor M5 and the first emission control transistor M5 in the pixel circuit to be turned on in the emission stale, and a current may flow through the emitting device L. In this case, an erratic display state occurs in the second display region, and user experience is severely affected. Therefore, in the conventional solution, a video source signal indicating a black screen, that is, a Vdata signal that makes a current flowing through the emitting device L close to 0, is usually selected for outputting to the second display region.

To further reduce power consumption of a display screen, an embodiment of this application provides a driving solution for a display driving system. In the solution, the display driving system may provide an independent EM management function for each of a plurality of display regions. This improves design flexibility of the display driving system, and makes it possible to reduce power consumption of the display screen drive circuit.

Figure 9:
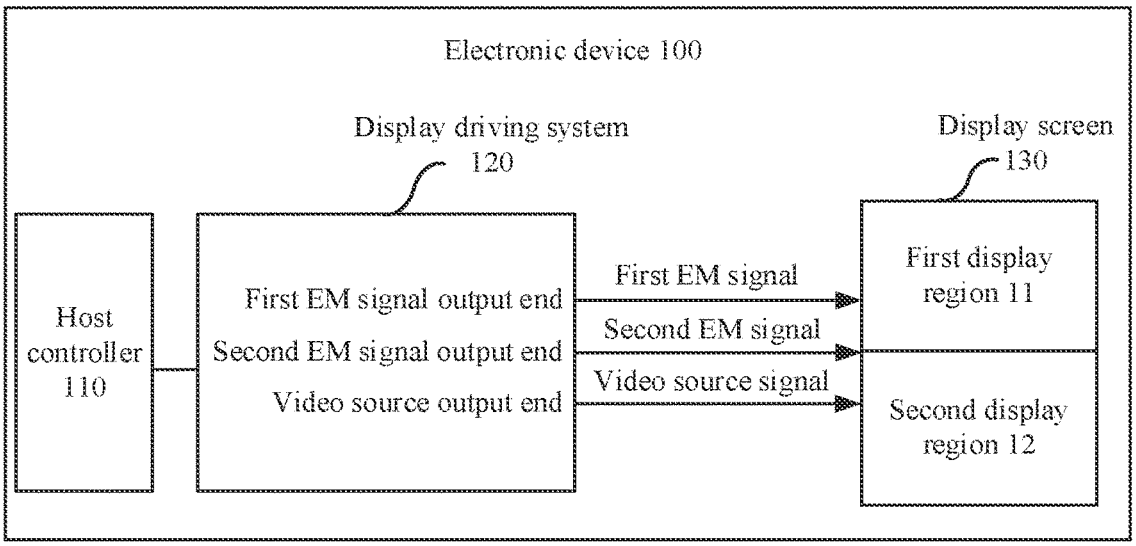
FIG. 9 is a schematic structural diagram of an electronic device according to an embodiment of this application.

FIG. 9 is a schematic structural diagram of an electronic device according to an embodiment of this application. As shown in FIG. 9, the electronic device 100 includes a host controller 110, a display driving system 120, and a display screen 130. The display screen 130 includes a first display region 11 and a second display region 12. The display screen 130 may be a foldable screen, or may be a non-foldable screen, or may be a flexible screen, or may be a hard display screen.

The display driving system 120 includes a first EM signal output end configured to send a first EM signal to the display screen 130. The display driving system 120 further includes a second EM signal output end, configured to send a second EM signal to the display screen 130. The first EM signal is used to control the first display region to display an image in a first time period, and the second EM signal is used to control the second display region not to display an image in the first time period; and/or the first EM signal is used to control the first display region not to display an image in a second time period, and the second EM signal is used to control the second display region to display an image in the second time period.

Optionally, the first EM signal is used to control the first display region to display an image in a third time period, and the second EM signal is used to control the second display region to display an image in the third time period.

The first EM signal and the second EM signal may be control signals used to control a pixel circuit in the display screen to emit light or not to emit light. As an example, the first EM signal and the second EM signal may be the EM signals described in FIG. 5 to FIG. 8. In other words, the first EM signal and the second EM signal are used to control the emitting device L in the pixel circuit to emit light in the emission stage of the pixel circuit.

Optionally, the first time period, the second time period, and/ or the third time period may include a plurality of time frames, and the display screen scans one image in each time frame. As an example, duration of each time frame may be 16.67 ms (ms), that is, a refresh rate of the display screen is 60 Hz.

As an example, assuming that the EM signal controls the emitting device L in the pixel circuit to emit light at a low level and controls the emitting device L in the pixel circuit not to emit light at a high level, when the display region displays an image, the EM signal is at a high level in the reset stage and the Vdata writing stage, but is at a low level in the emission stage. Therefore, when the display screen displays an image, the EM signal in each time frame is a pulse width modulation (pulse width modulation, PWM) signal, that is, the EM signal is in a state of fast switching between a high level and a low level, and may be referred to as an EM signal is in a normal working state in this embodiment of this application. Because a switching frequency of the EM signal is high, based on a visual staying phenomenon of human eyes, from a perspective of the human eyes, the display region is always in a state of displaying an image. When the display region does not display an image, the EM signal is always in a high-level state in a plurality of consecutive time frames, and may be referred to as EM signal in an off state in this embodiment of this application. In other words, from the perspective of the human eyes, the display region is in a state of not displaying an image.

Optionally, the EM signal may alternatively control the emitting device L in the pixel circuit to emit light at a high level, and control the emitting device L in the pixel circuit not to emit light at a low level. Therefore, in this case, when the EM signal is at a low level in a plurality of time frames, the display region controlled by the EM signal does not display an image.

In an example, in the foregoing first time period, the first EM signal is a signal (for example, a PWM signal) that transitions between a first level and a second level or remains at a first level, and the second EM signal remains at the second level; and/or in the foregoing second time period, the first EM signal remains at the first level, and the second EM signal is a signal (for example, a PWM signal) that transitions between the first level and the second level or remains at the first level; and/or in the foregoing third time period, both the first EM signal and the second EM signal are signals (for example, PWM signals) that transition between the first level and the second level, or both remain at the first level.

When the EM signal is at the first level, the EM signal is used to control the emitting device in the pixel circuit to emit light, or when the EM signal is at the second level, the EM signal is used to control the emitting device in the pixel circuit not to emit light. In an example, the first level is a high level and the second level is a low level. Alternatively, in another example, the first level is a low level and the second level is a high level.

In this embodiment of this application, the display driving system 120 controls the first display region 11 and the second display region 12 in the display screen by using the first EM signal and the second EM signal that are mutually independent, to provide independent EM management functions for different display regions. In a time period in which one of the display regions does not display an image, the EM signal may control the pixel circuit in the display region not to emit light. Using the description of the pixel circuit in the emission stage in FIG. 8 as an example, in a time period in which the EM signal controls the display region not to display an image, the EM signal may control the second emission control transistor M5 and the first emission control transistor M6 not to be turned on. Therefore, a path between the ELVDD and the ELVSS is unavailable, and no current flows through the emitting device L. Therefore, there is no need to set the voltage of the Vdata to enable the pixel circuit not to emit light. In other words, because an independent EM management function is provided for each display region, the display driving system may turn off a corresponding video source signal in a time period in which a display region does not display an image, thereby reducing power consumption.

In this embodiment of this application, different EM signals are used to independently control emitting and non-emitting stales of pixel circuits in each of a plurality of display regions of the display screen, to provide an independent EM management function for each display region. Therefore, when a display region does not display an image, an EM signal may be used to control the display region not to display an image, and there is no need to always output a video source signal indicating a black screen. This improves design flexibility of the display driving system, and makes it possible to reduce power consumption of a display screen drive circuit.

The display driving system 120 further includes a video output end configured to output a video source signal, where the video source signal is used to drive the display screen to display an image.

Optionally, when the first display region displays an image and the second display region does not display an image, the video source output end is further configured to output a video source signal corresponding to the first display region in the first time interval in a first time frame, and turn off a video source signal corresponding to the second display region in the second time interval in the first time frame, where the first time frame belongs to the first time period.

Similarly, when the first display region does not display an image and the second display region displays an image, the video source output end is further configured to turn off a video source signal corresponding to the first display region in the first time interval in the sixth time frame, and output a video source signal corresponding to the second display region in the sixth time interval in the sixth time frame, where the sixth time frame belongs to the second time period.

In this embodiment of this application, in a time period in which one of the plurality of display regions does not display an image, the display driving system may turn off a video source signal corresponding to the display region in a corresponding partial time interval in each time frame, thereby reducing power consumption of the display driving system.

That the display driving system turns off a video source signal may include opening the video source output end or setting a bias voltage. Optionally, in a corresponding time interval in which the video source signal is turned off in each time frame, all or some modules of the display drive circuit that are configured to process the corresponding video source signal may also be turned of, to reduce power consumption.

The display driving system may include one display drive circuit, or may include a plurality of display drive circuits. When the display driving system includes a plurality of display drive circuits, an interface may exist between the plurality of display drive circuits.

Figure 10:
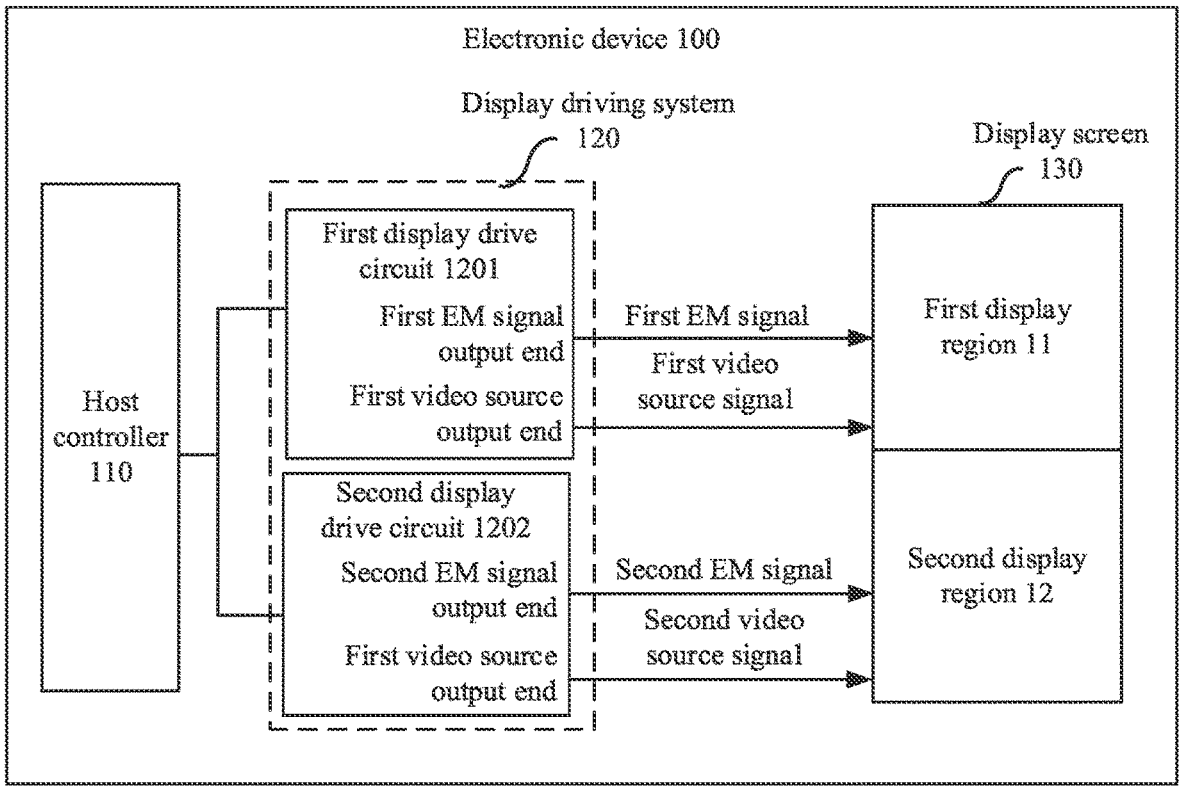
FIG. 10 is a schematic structural diagram of an electronic device according to another embodiment of this application.

As an example, FIG. 10 is a schematic structural diagram of an electronic device according to another embodiment of this application. The display driving system in FIG. 10 includes a plurality of display drive circuits. As shown in FIG. 10, the display driving system 120 may include a first display drive circuit 1201 and a second display drive circuit 1202. The first display drive circuit 1201 is configured to output the first EM signal and a first video source signal corresponding to the first display region 11. The second display drive circuit 1202 is configured to output the second EM signal and a second video source signal corresponding to the second display region 12. An interface (not shown in FIG. 10) may exist between the first display drive circuit 1201 and the second display circuit 1202, to facilitate synchronization and interaction between the plurality of display drive circuits. An operating principle of the display driving system in FIG. 10 is the same as or similar to that of the electronic device in FIG. 10, and details are not described herein again.

Optionally, the display driving system may provide an independent supply voltage management function for each of the plurality of display regions in a display screen.

Figure 11:
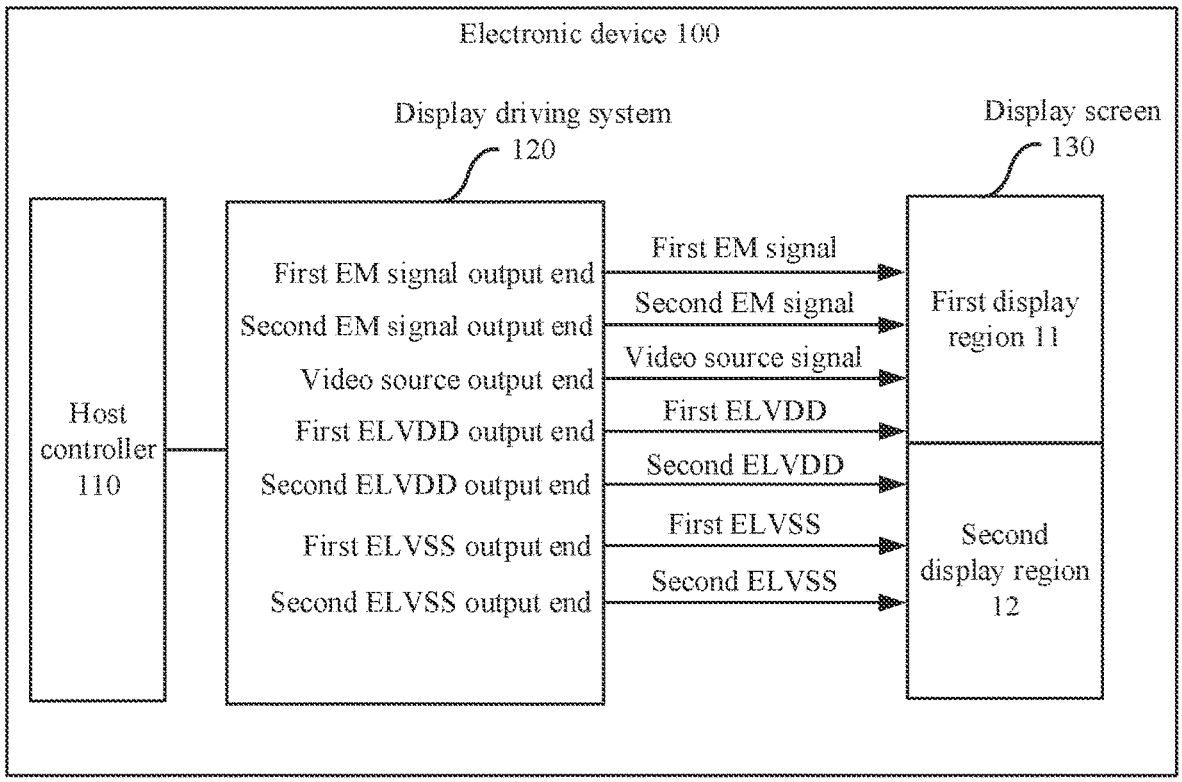
FIG. 11 is a schematic structural diagram of an electronic device according to another embodiment of this application.

FIG. 11 is a schematic structural diagram of an electronic device according to another embodiment of this application. As shown in FIG. 11, the display driving system 120 further includes: a first emission layer positive voltage (emission layer VDD, ELVDD) output end, configured to output a first ELVDD, where the first ELVDD is used to provide a high supply voltage for a pixel circuit in the first display region; and a second ELVDD output end, configured to output a second ELVDD, where the second ELVDD is used to provide a high supply voltage for a pixel circuit in the second display region, and voltage values of the first ELVDD and the second ELVDD may be different. As an example, when one of the display regions does not display an image, the display driving system may turn off a supply voltage of the display region. For example, the first ELVDD may be a working voltage, and the second ELVDD may be 0 or open or biased to another voltage.

As an example, the first ELVDD and the second ELVDD many include the ELVDD in FIG. 5 to FIG. 8.

Still referring to FIG. 11, the display driving system further includes: a first emission layer negative voltage (emission layer VSS, ELVSS) output end, configured to output a first ELVSS, where the first ELVSS is used to provide a low supply voltage for a pixel circuit in the first display region; and a second ELVSS output end, configured to output a second ELVSS, where the second ELVSS is used to provide a low supply voltage for a pixel circuit in the second display region, and voltage values of the first ELVSS and the second ELVSS may be different. For example, the voltage value of the first ELVSS may be 0 or GND, and the voltage value of the second ELVSS may be open or another bias voltage.

The first ELVSS and the second ELVSS may include the ELVSS in FIG. 5 to FIG. 8.

In this embodiment of this application, the display driving system may provide an independent supply voltage signal for each of the plurality of display regions, thereby facilitating independent management of supply voltages of different display regions, and improving design flexibility of the display driving system.

Optionally, the display driving system may further provide independent GOA clock control management for different display regions, and provide mutually independent GOA signals for different display regions. The GOA signals are used to control turn-on and turn-off of GOAs. As an example, the display driving system further includes a first GOA output end configured to output a first GOA signal corresponding to the first display region to the display screen, where the first GOA signal is used to control a GOA in the first display region to be turned on or off. The display driving system further includes a second GOA output end configured to output a second GOA signal, where the second GOA signal is used to control a GOA in the second display region to be turned on or off. In a time period, phases, voltage values, or voltage value switching states between the first GOA signal and the second GOA signal may be the same or different.

In this embodiment of this application, the display driving system may provide an independent GOA clock signal for each of the plurality of display regions, thereby facilitating independent management of turn-on and turn-off of GOAs in different display regions, and improving design flexibility of the display driving system.

Figure 12:
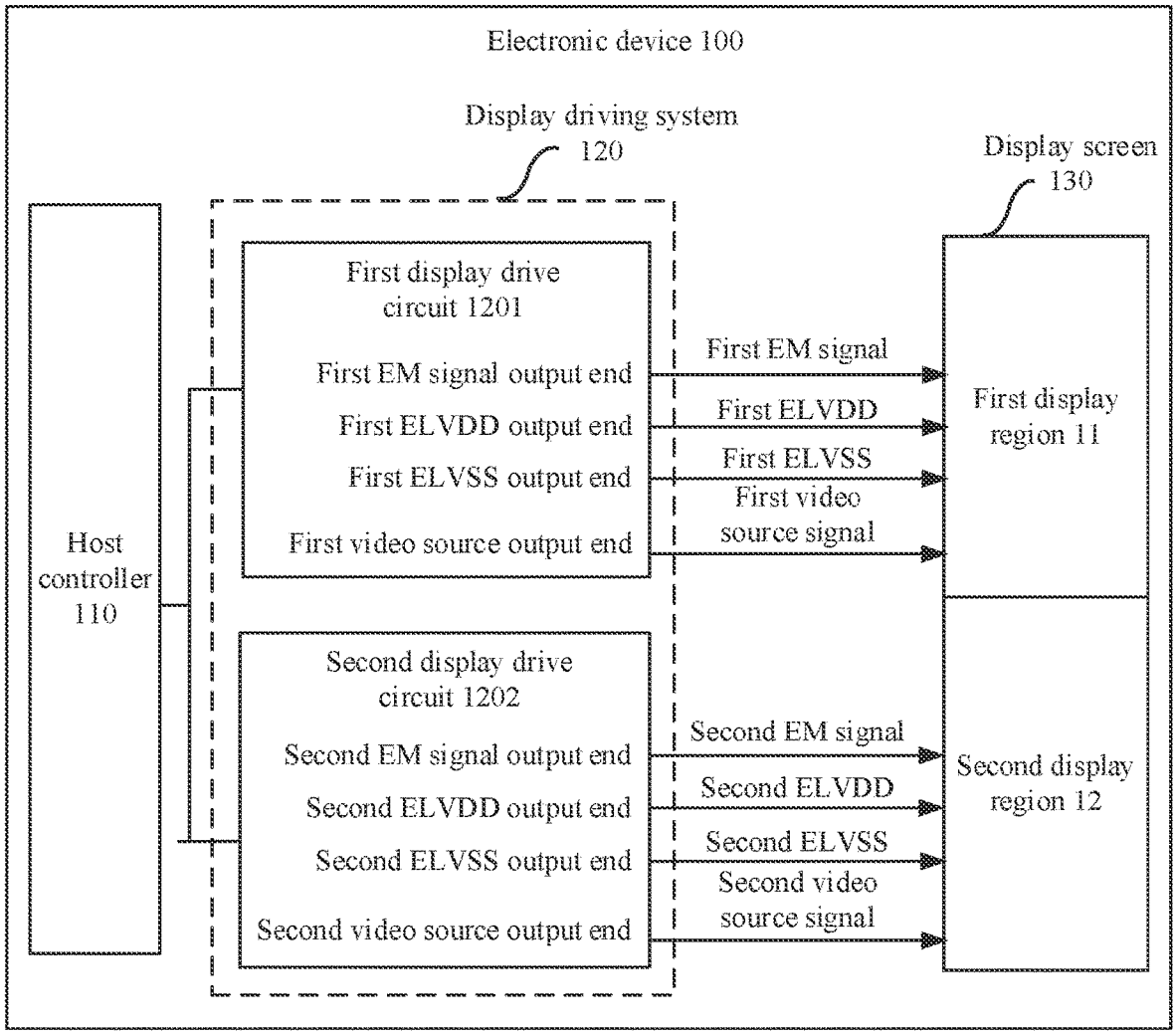
FIG. 12 is a schematic structural diagram of an electronic device according to another embodiment of this application.

FIG. 12 is a schematic structural diagram of an electronic device according to another embodiment of this application. The display driving system in FIG. 12 includes a plurality of display drive circuits. As shown in FIG. 12, the display driving system 120 includes a first display drive circuit 1201 and a second display drive circuit 1202. The first display drive circuit 1201 further includes a first ELVDD output end and a first ELVSS output end, and the second display drive circuit 1202 further includes a second ELVDD output end and a second ELVSS output end. An operating principle of the display driving system in FIG. 12 is the same as or similar to that of the display driving system in FIG. 11, and details are not described herein again.

To avoid erratic display in a process of switching a display region between a display state and a non-display state, before the state switching, the display driving system may first instruct, by using a video source signal, the display region to display a black screen, and then switch to an image display state or a non image display state, so that a phenomenon of erratic display can be avoided, and that user experience can be improved.

Assuming that the display region switches from displaying an image to not displaying an image, the video source output end may first send, to the display region within duration of one time frame or a plurality of time frames, a video source signal indicating a black screen, to instruct the display region to display the black screen. In addition, the video source signal corresponding to the display region is turned off in one or more time frames after the time frame indicating the black screen, to avoid erratic display and improve user experience. It should be noted that in this embodiment of this application, for human eyes, there is no difference between the display region in a black screen state and the display region in a source off state, that is, in the foregoing two states, no image is displayed in the display region seen by the human eyes.

In an example, assuming that the first display region switches from displaying an image to a non-display state, the video source output end is further configured to output, in the first time interval in a second time frame, a video source signal corresponding to the first display region and indicating a black screen, where the second time frame is adjacent to a third time frame and is located before the third time frame, and the first EM signal is further used to control the first display region to switch from displaying an image to not displaying an image, starting from the third time frame.

Assuming that the display region switches from a non-display state to displaying an image, the video source output end may first send, to the display region within duration of one time frame or a plurality of time frames, a video source signal indicating a black screen, to instruct the display region to display the black screen and display an image in one or more time frames after the time frame indicating the black screen.

In an example, assuming that the first display region switches from displaying an image to not displaying an image, the video source output end is further configured to output, in the first time interval in a fourth time frame, a video source signal corresponding to the first display region and indicating a black screen, where the fourth time frame is adjacent to a fifth time frame and is located before the fifth time frame, and the first EM signal is further used to control the first display region to switch from not displaying an image to displaying an image, starting from the fourth time frame.

Optionally, the display driving system usually needs to perform brightness processing on video data before outputting the video source signal. Usually, brightness processing is performed on the video data in two modes. The first mode is pulse width modulation (pulse width modulation, PWM), that is, brightness is adjusted by adjusting a duty ratio of an EM signal. If an emission time of a pixel circuit controlled by the EM signal in one time frame is longer, display brightness of the display region is higher; otherwise, display brightness of the display region is lower. For example, assuming that duration of a time frame is 16 ms, the EM signal controls the pixel circuit to emit light within 8 ms and controls the pixel circuit not to emit light within remaining 8 ms. If the brightness needs to be increased, the EM signal may be set to control the pixel circuit to emit light within 10 ms, and control the pixel circuit not to emit light within remaining 6 ms. In the prior art, EM signals of a plurality of display regions in a display screen are controlled by a same EM management module; therefore, the plurality of display regions can only use a same brightness control mode. In this embodiment of this application, because a plurality of EM signals are used to independently manage a plurality of display regions, different display regions may use different brightness control modes, thereby improving user experience. For example, if a user needs to use the first display region to view a video and use the second display region to browse web pages, brightness of the two display regions may be adjusted to different values.

The second brightness control mode is to adjust brightness based on a voltage and a current, that is, the brightness may be adjusted based on a voltage value of the Vdata. A digital circuit part in the display driving system generally includes a brightness processing module, configured to perform brightness processing on video data. In this embodiment of this application, the brightness processing module may perform brightness calibration on video data in different display regions based on different brightness calibration parameters. Therefore, different brightness control modes may be used for different display regions, thereby improving user experience.

As an example, an OLED display screen generally adjusts brightness of a display region by using a combination of the foregoing two modes.

It should be noted that brightness processing generally includes gamma calibration. Gamma calibration is a manner of adjusting brightness or contrast of an image. Specifically, in the image display field, because sensitivity of a human visual system is in an approximately logarithmic relationship with the brightness of the display screen, rather than a non-linear relationship, to ensure that an image presented by the display screen is the same as an original image, gamma calibration needs to be introduced into the display screen to adjust a grayscale curve of the display screen, to achieve a best visual effect. The grayscale curve is a characteristic curve indicating a relationship between different grayscales and brightness of the display screen. The gamma calibration may be implemented by using a gamma lookup table (look up table, LUT). The gamma LUT may be a mapping table of pixel grayscale values. The gamma LUT may convert an actually sampled pixel grayscale value into another corresponding grayscale value through transformation, such as threshold, inversion, binarization, contrast adjustment, and linear transformation. In this way, useful information of the image is highlighted and the contrast of the image is enhanced.

In this embodiment of this application, different brightness calibration parameters may be used to generate video source signals of different display regions. Therefore, brightness of different display regions may be different, design flexibility of the display driving system is improved, and user experience is improved.

Optionally, in this embodiment of this application, different brightness processing modules may be used to implement brightness control functions for different display regions, or a same brightness processing module may be used to implement brightness control functions for different display regions. The brightness processing module is generally located in the digital circuit part in the display driving system. In an example, the brightness processing module may be a voltage code generator (voltage code generator).

In an example, the video source signal corresponding to the first display region and the video source signal corresponding, to the second display region are generated based on different brightness calibration parameters. Optionally, the brightness calibration parameter includes a display brightness vector (display brightness vector, DBV).

In this embodiment of this application, because independent brightness control management is used fur different display regions, each display region is not limited by a brightness level of another display region in a brightness adjustment range, and a degree of freedom of brightness adjustment of each display region is improved.

Figure 13:
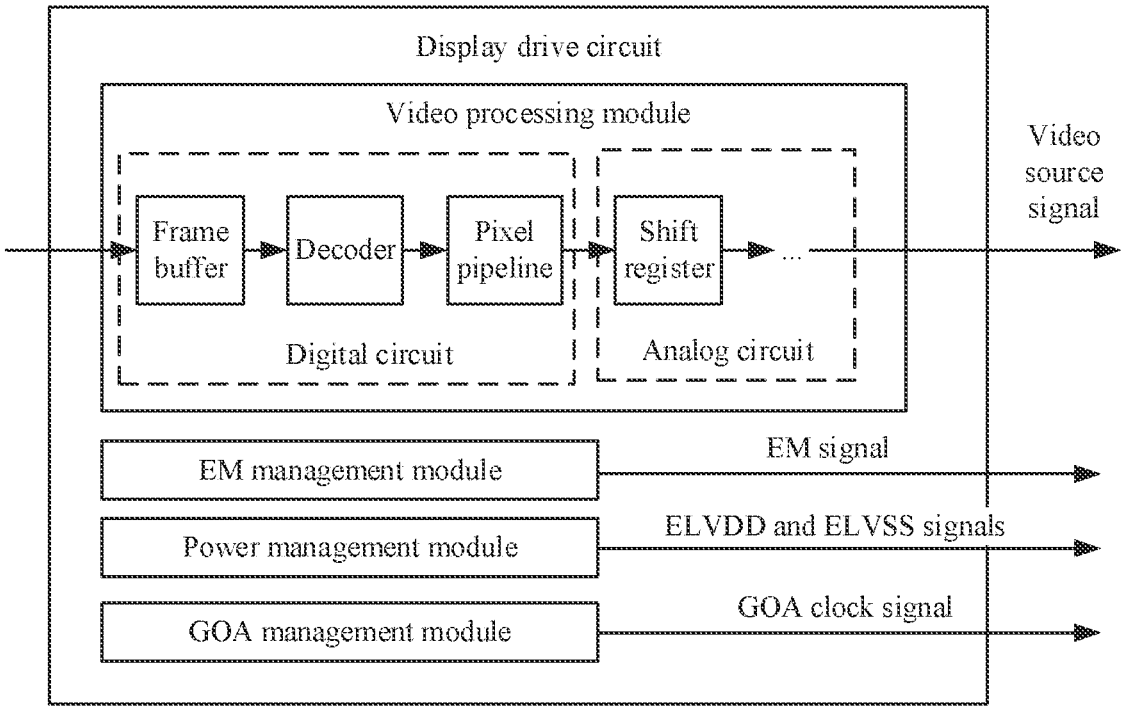
FIG. 13 is a schematic structural diagram of a display driving system according to an embodiment of this application.

FIG. 13 is a schematic structural diagram of a display drive circuit according to an embodiment of this application. As shown in FIG. 13, the display drive circuit includes a video processing module, an EM management module, a power management module, and a GOA management module. It should be noted that a structure in FIG. 13 is merely used as an example. The display drive circuit may include more or fewer functional modules than the foregoing modules. This is not limited in this embodiment of this application.

It should be noted that the display drive circuit may be configured to drive one display region in a display screen, or may be configured to drive a plurality of display regions in a display screen. In the following description, it is assumed that the display drive circuit drives a first display region and a second display region. A person skilled in the art can understand that if the display drive circuit is used to drive only one display region in the display screen, the display drive circuit is only configured to output a video source signal, an EM signal, a GOA signal, and a supply voltage signal that correspond to the display region. For brevity, details are not described again.

The video processing module is configured to receive video data from a host controller, process the video data, and generate and output a video source signal. The video processing module includes a digital circuit part and an analog circuit part. As an example, the digital circuit part may include but is not limited to a frame buffer (frame buffers), a decoder (decoder), and a pixel pipeline (pixel pipeline). The pixel pipeline includes a plurality of modules for pipeline processing of pixel data, such as a voltage code generator, where the voltage code generator may be configured to perform brightness control. The analog processing part includes but is not limited to modules such as a shift register (shifter register), a data latch, a digital-to-analog converter (digital analog convertor, DAC), a data output buffer, and the like.

It should be noted that when the display drive circuit drives two display regions, the display drive circuit may include one video source output end, and output a video source signal corresponding to the first display region and a video source signal corresponding to the second display region by using the video output end. Alternatively, the display drive circuit may include two video source output ends respectively configured to output video source signals of the first display region and the second display region.

The EM management module is configured to output an EM signal to the display screen. The EM management module may output a first EM signal corresponding to the first display region, and/or output a second EM signal corresponding to the second display region. In a time period, phases of the first EM signal and the second EM signal may be the same or different.

The power management module is configured to output an ELVDD and an ELVSS to the display screen. Optionally, the power management module may output a same ELVDD voltage and a same ELVSS voltage to different display regions, or may output different ELVDD voltages and different ELVSS voltages to different display regions. For example, the power management module may output a first ELVDD and a first ELVSS corresponding to the first display region, and/or output a second ELVDD and a second ELVSS corresponding to the second display region. In some examples, the power management module may include a power management integrated circuit (power management integrate circuit, PMIC).

The GOA management module is configured to output a GOA signal. The GOA signal is used to control turn-on and turn-off of a GOA in the display screen. The GOA management module may output GOA signals that vary independently of each other to different display regions. Optionally, the GOA management module may output GOA clock signals with a same phase, voltage value, and on state or off state to different display regions, or may output GOA clock signals with different phases, voltage values, and on states or off states to different display regions. As an example, the GOA management module generally outputs a pair of mutually phase-inverted GOA signals to each display region to control turn-on and turn-off of the GOA array.

Optionally, the EM management module may be configured to provide independent EM management for each display region. The video processing module may be configured to provide an independent brightness control function for displaying an image in each display region. The power management module may be configured to provide an independent working voltage for each display region. The GOA management module may be configured to provide an independent GOA signal for each display region.

The EM management module may implement EM management for the plurality of display regions by using same hardware, or may implement EM management for the plurality of display regions by using different hardware. Similarly, the video processing module may implement brightness control for the plurality of display regions by using same hardware, or may implement brightness control for the plurality of display regions by using different hardware. The power management module may implement supply voltage management the plurality of display regions by using same hardware, or may implement supply voltage management for the plurality of display regions by using different hardware. The GOA management module may implement GOA control for the plurality of display regions by using same hardware, or may implement electrical GOA control for the plurality of display regions by using different hardware.

When the foregoing modules manage the display regions by using different hardware, if a display region does not display an image, a hardware module corresponding to the display region may be turned of. For example, if the first display region does not display an image, all or some hardware modules corresponding to the first display region among the video processing module, the EM management module, the power management module, and/or the GOA management module may be turned off.

Optionally, the display screen driving solution in this application is intended to support two or more independent display regions in one display screen, and each independent display region may be completely consistent or completely different in terms of pixel density (pixel per inch, PPI), pixel arrangement (pixel arrangement), aperture ratio (aperture ratio), pixel current density (pixel current density), and brightness level. Therefore, a display driving system may include two or more sets of independent EM management modules, video processing modules, power management modules, and/or GOA management modules. As an example, the display driving system may include two or more display drive circuits, each for controlling an independent display region. Phases, voltage values, and off or on states of EM signals, ELVDDs, ELVSSs, and/or GOA clock signals output by each display drive circuit may be the same or different. Image brightness of the display region corresponding to each display drive circuit may be independently adjusted. As another example, the display driving system may alternatively include one display drive circuit, and phases, voltage values, and off or on states of EM signals, ELVDDs, ELVSSs, and/or GOA clock signals output by the display drive circuit to different display regions may be the same or may be different. The display drive circuit may independently adjust brightness of different display regions.

Figure 14:
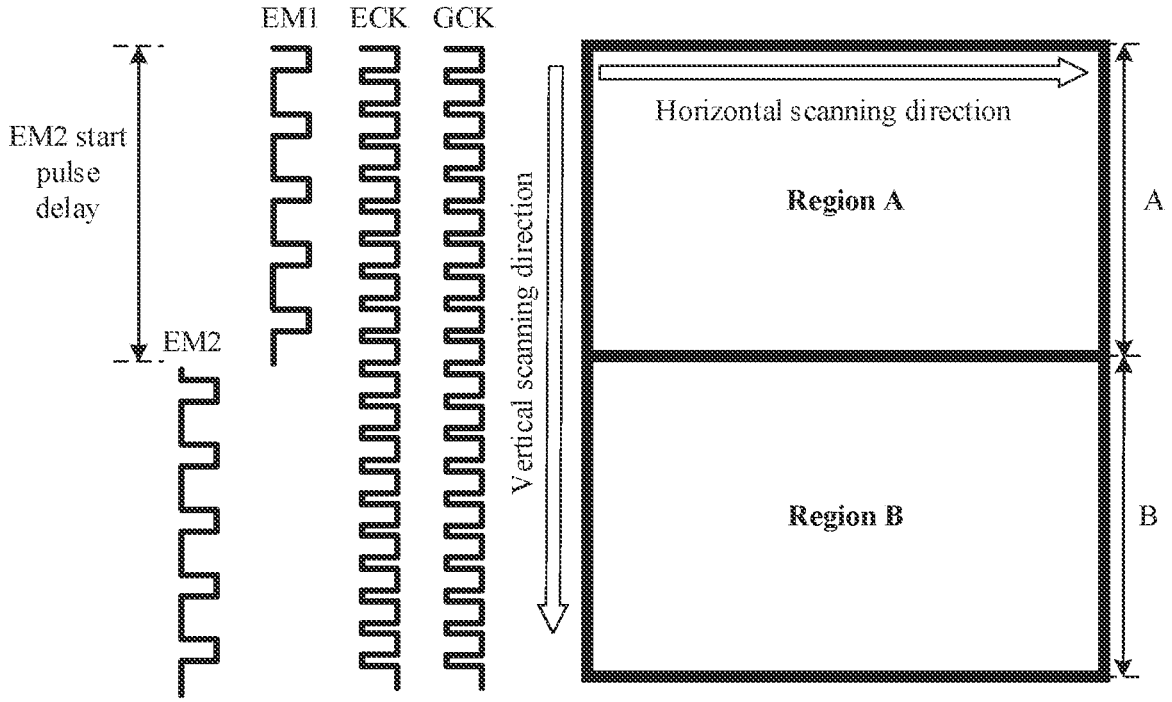
FIG. 14 is a schematic diagram of a clock signal in a display driving system according to an embodiment of this application.

FIG. 14 is a schematic time sequence diagram of a clock signal in a display driving system according to an embodiment of this application. EM1 denotes a first EM signal, EM2 denotes a second EM signal, ECK denotes an EM clock (emission clock, ECK) signal, and GCK denotes a gate driver on array clock (GOA clock, GCK) signal. The ECK is used to control the EM signal, and the GCK is used to control the GOA signal. FIG. 14 also shows a horizontal scanning direction and a vertical scanning direction of an image on a display screen. The horizontal scanning direction represents a scanning direction of each row of subpixels, and the vertical scanning direction represents a scanning direction of a GOA. Optionally, to ensure synchronization of the EM1 signal and the EM2 signal in synchronous row scanning, the two EM signals need to run in a series architecture. Therefore, an EM management module in the display driving system also needs to provide an ECK signal to implement and ensure a start delay in series. In a time sequence design, the ECK signal and the GCK signal can be synchronized in two display regions to ensure that the GOA clock signal and the EM clock signal on each line are consistent in full screen display. In this embodiment of this application, the display driving system uses different EM start pulse delay signals for different EM signals. The EM start pulse delay (EM start pulse delay) signal is used to control a moment of state switching of the EM signal. For example, the EM signal can be switched from a normal working state to an off state or from an off state to a normal working state only when the EM start pulse delay signal is triggered.

Figure 15:
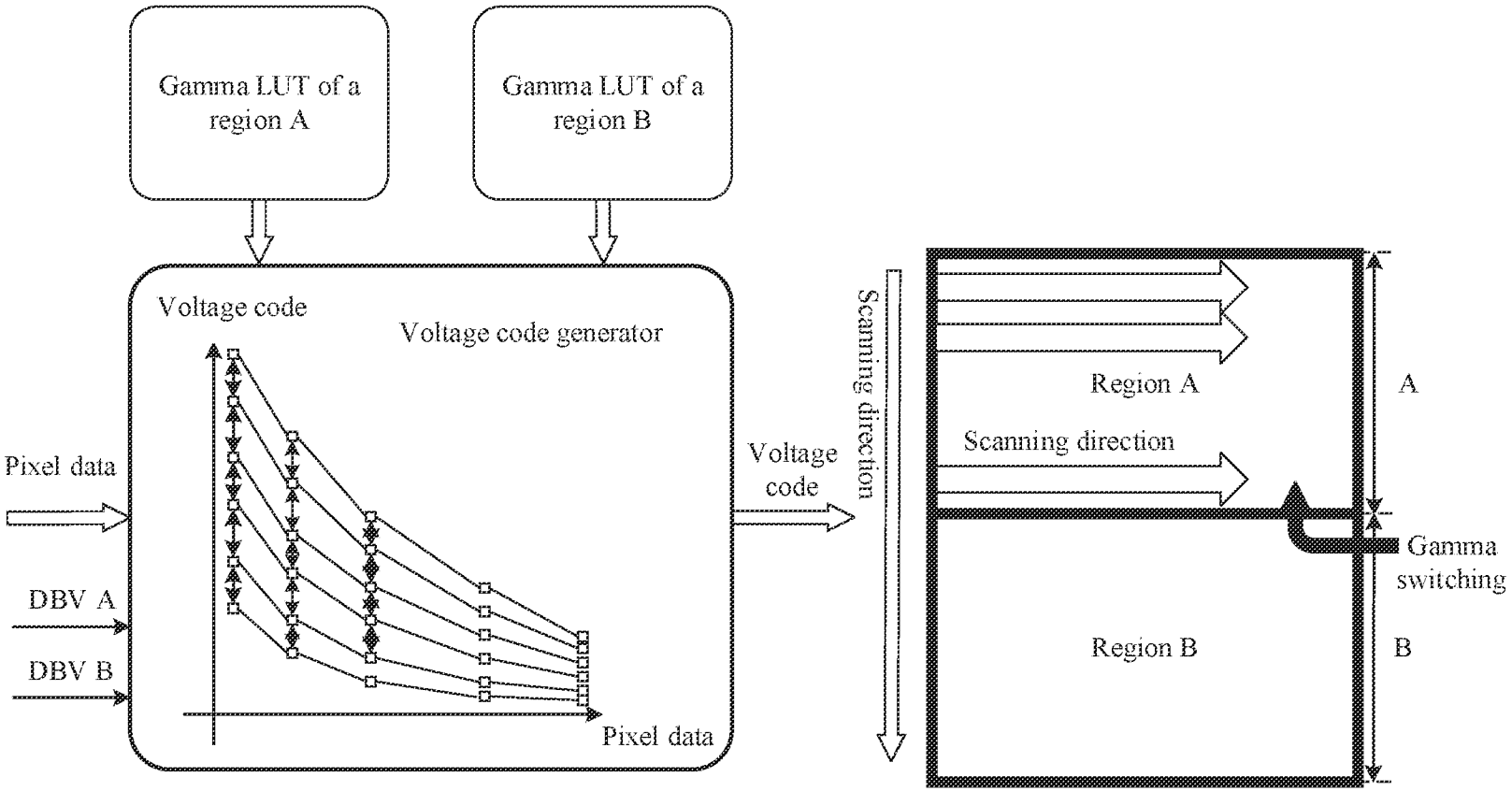
FIG. 15 is a schematic diagram of a brightness control method for a display driving system according to an embodiment of this application.

FIG. 15 is a schematic diagram of a brightness control method for a display driving system according to an embodiment of this application. Brightness control may be performed by a voltage code generator (voltage code generator). Specifically, the voltage code generator receives pixel data (pixel data) and a DBV A and a DBV B that are independent of each other, selects, based on the DBV A, parameters from a gamma LUT corresponding to a region A, generates a voltage code of the region A in a display screen, selects, based on the DBV B, parameters from a gamma LUT corresponding to a region B, and generates a voltage code in the region B in the display screen. After the voltage code undergoes subsequent processing in a video processing module, a video source signal used for displaying an image on the display screen is generated.

The voltage code generator may generate, based on different DBVs, voltage codes corresponding to different display regions, and implement fast gamma switching (gamma switch) between two display regions. The gamma switching may mean that after scanning of the region A is completed, the region B starts to continue scanning an image based on a brightness calibration parameter different from that of the region A. Because updating of a gamma adjustment point (that is, gamma switching) is completed in a digital circuit part, updating of the gamma adjustment point may be performed in a plurality of pixel cycles. Optionally, a speed of an internal pixel clock of the voltage code generator may be increased to compensate for a time for inserting a gamma voltage adjustment point into an internal pipeline. In addition, in the scanning process, a dummy line (dummy line) may be inserted between the two display regions to compensate for a setting time of a gamma voltage. The dummy line may also be understood as a blank GOA.

FIG. 16 to FIG. 25 are time sequence diagrams of clock signals of a display driving system in different display states. With reference to FIG. 16 to FIG. 25, the following continues to describe a method for driving a display screen in an embodiment of this application.

Figure 16:
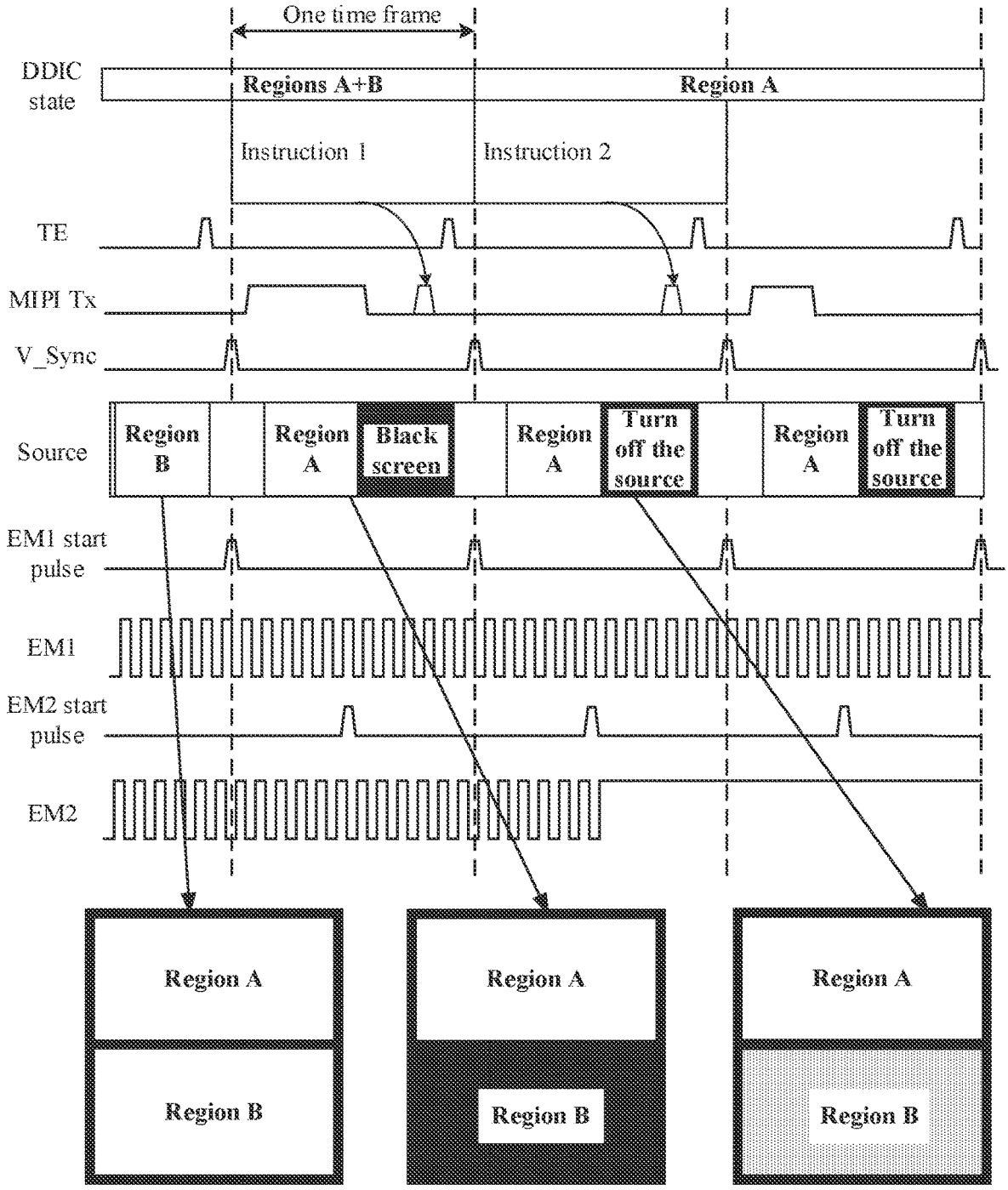
FIG. 16 is a time sequence diagram of switching a display state of a foldable display screen from regions A+B to a region A according to an embodiment of this application.

FIG. 16 is a time sequence diagram of switching an image display region from regions A+B to a region A. As shown in FIG. 16, an EM1 signal and an EM2 signal are respectively used to control the region A and the region B to display or not to display an image. An EM1 start pulse (EM1 start pulse) signal is used to control a state switching time of the EM1 signal. Similarly, an EM2 start pulse (EM2 start pulse) signal is used to control a state switching time of the EM2 signal. A source signal is the foregoing video source signal. A TE signal represents a clock synchronization signal of a display driving system. A V_Sync signal represents a vertical synchronization signal. A MIPI Tx signal represents an instruction sent by a host controller (host controller) of an electronic device to a DDIC, and the instruction is used to instruct a display screen to switch from the regions A+B to the region A. Optionally, in specific practice, the instruction may include several pieces of indication information related to region switching.

For example, as an example rather than a limitation, the foregoing instructions include an instruction 1 and an instruction 2. The instruction 1 is used to indicate the following content:

(1) The host controller (host controller) supports sending a black screen image (black image) in the region B.

(2) The DDIC switches to a state of the region A at a next vertical synchronization (V-Sync) moment by using a host command that indicates a region mode register update (region mode register update).

The instruction 2 is used to indicate the following content:

(1) The DDIC bypasses (bypass) a frame buffer and a decoder in the region B.

(2) The DDIC reads start column and row addresses at a first pixel of the region A.

(3) Receive, from the host controller, a host command for writing the start column and row addresses, where the host command may be supported in a previous or subsequent frame.

(4) A source (source) operational amplifier is turned off in the region B.

(5) The EM2 start pulse signal triggers the EM1 signal to be at a high level (H).

As shown in FIG. 16, in a time frame in which the instruction 1 is received, the source signal instructs the region B to display a black screen, so that the region B switches to displaying the black screen. In a time frame in which the instruction 2 is received, the EM2 signal is converted into a high level to instruct to turn off a pixel circuit of the region B while the display driving system turns off the source signal in a time interval for scanning the region B in each time frame. In FIG. 16, the display screen may switch from the regions A+B to a mode of the region A in two time frames. Alternatively, if the instruction 1 and the instruction 2 may be sent to the display driving system in a same time frame, the display screen may complete display state switching in one time frame, and this is also applicable to subsequent embodiments. Therefore, fast switching of the display state of the display screen can be implemented in this application.

Figure 17:
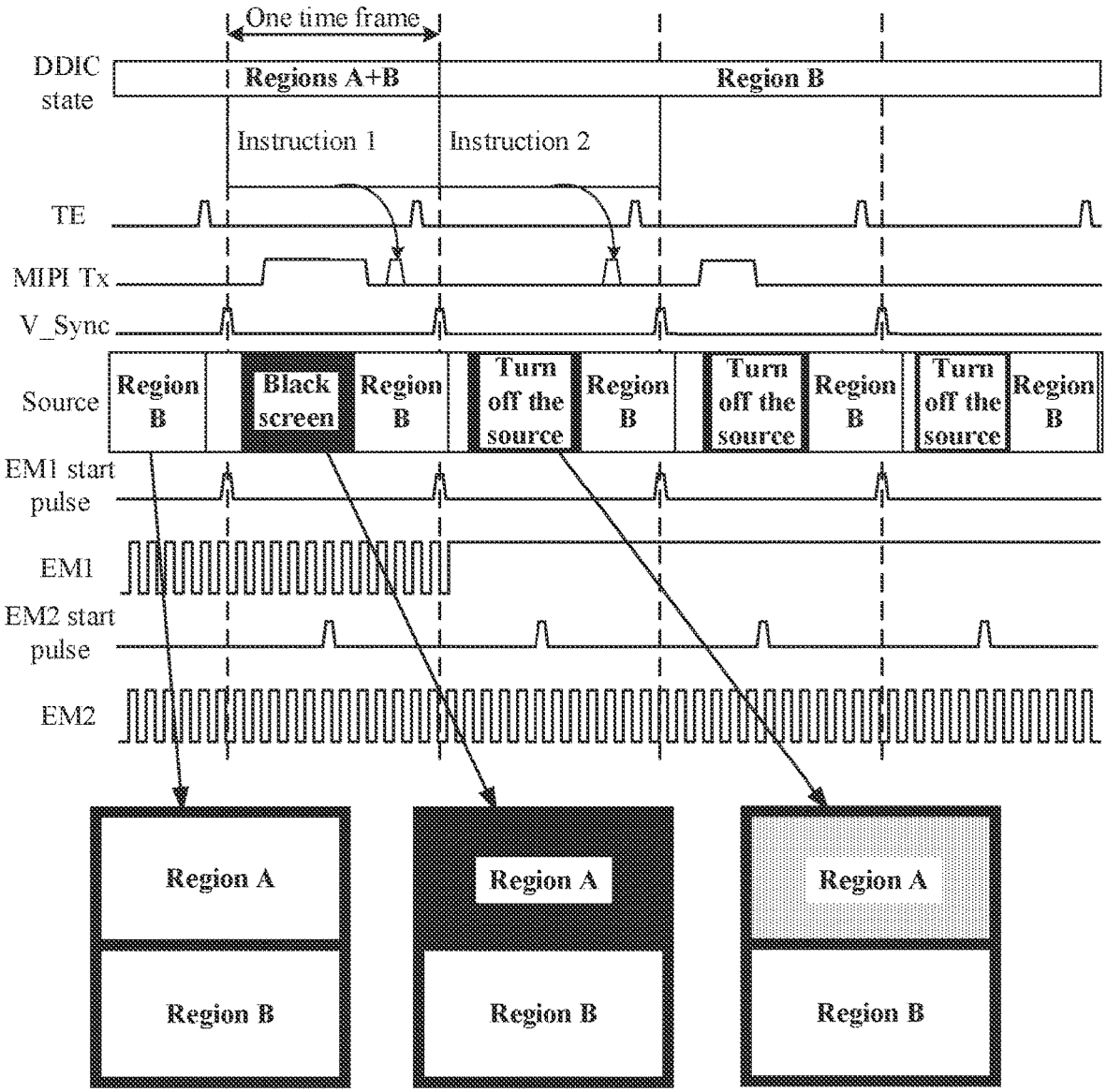
FIG. 17 is a time sequence diagram of switching a display state of a foldable display screen from regions A+B to a region B according to an embodiment of this application.

FIG. 17 is a time sequence diagram of switching a display state of a display screen from regions A⇆B to a region B. Definitions and functions of signals in FIG. 17 are the same as those in FIG. 16, and details are not described herein again. As an example rather than a limitation, an instruction 1 in FIG. 17 may be used to indicate the following content:

(1) A host controller (host controller) supports sending a black screen image in the region A.

(2) A DDIC switches to a state of the region B at a next vertical synchronization (V-Sync) moment by receiving a host command that indicates a region mode register update.

An instruction 2 is used to indicate the following content:

(1) The DDIC bypasses a frame buffer and a decoder in the region A.

(2) The DDIC reads start column and row addresses at a first pixel of the region B.

(3) Receive, from the host controller, a host command for writing the start column and row addresses, where the host command may be supported in a previous or subsequent frame.

(4) A source (source) operational amplifier is turned off in the region A.

(5) An EM1 start pulse signal triggers an EM2 signal to be at a high level (H).

As shown in FIG. 17, in a time frame in which the instruction 1 is received, the source signal instructs the region A to display a black screen, so that the region A switches to displaying the black screen. In a time frame in which the instruction 2 is received, an EM1 signal is converted into a high level to instruct the region A not to display an image while a display driving system turns off the source signal in a time interval for scanning the region A in each time frame.

Figure 18:
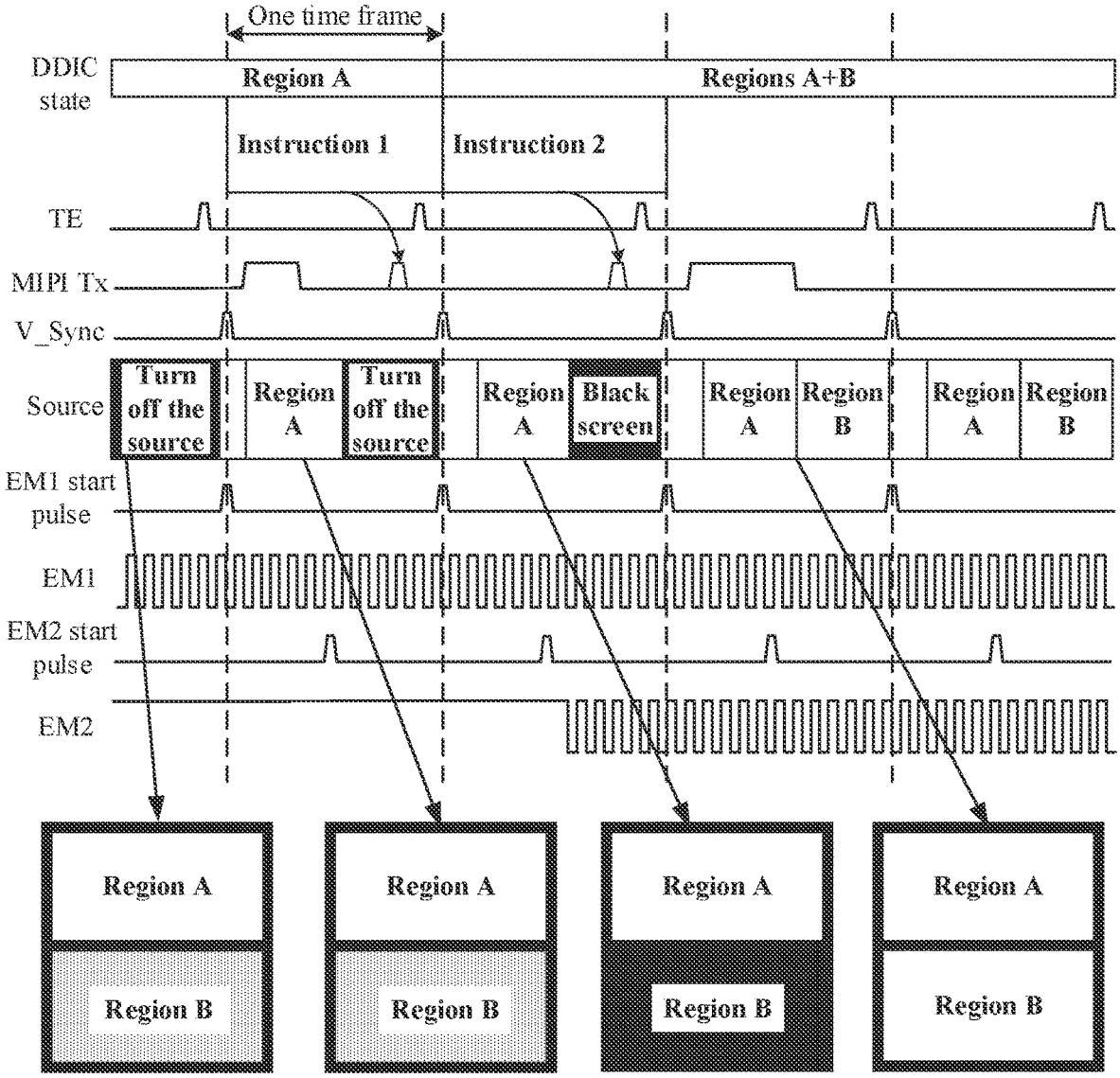
FIG. 18 is a time sequence diagram of switching a display state of a foldable display screen from a region A to regions A+B according to an embodiment of this application.

FIG. 18 is a time sequence diagram of switching a display state of a display screen from a region A to regions A+B according to an embodiment of this application. For definitions and functions of signals in FIG. 18, refer to the foregoing descriptions. Details are not described herein again. As an example rather than a limitation, an instruction 1 in FIG. 18 may be used to indicate the following content:

(1) A DDIC switches to a state of the regions ATB at a next vertical synchronization (V-Sync) moment by receiving a host command that indicates a region mode register update.

(2) A source channel (source channel) remains in an off state in the region B.

An instruction 2 is used to indicate the following content:

(1) The DDIC reads start column and row addresses at a first pixel of the region A.

(2) Receive, from a host controller, a host command for writing the start column and row addresses, where the host command may be supported in a previous or subsequent frame.

(3) A source (source) starts to run normally at a beginning of the region B.

(4) An EM2 starts to run normally.

As shown in FIG. 18, after the instruction 1 and the instruction 2 are received, an EM1 signal remains unchanged, and the EM2 signal changes from a high level to a normal output after passing through an EM2 start pulse. The region A remains in a normal display state, while the region B switches from a source off state to a black screen state, and then to the normal display state.

Figure 19:
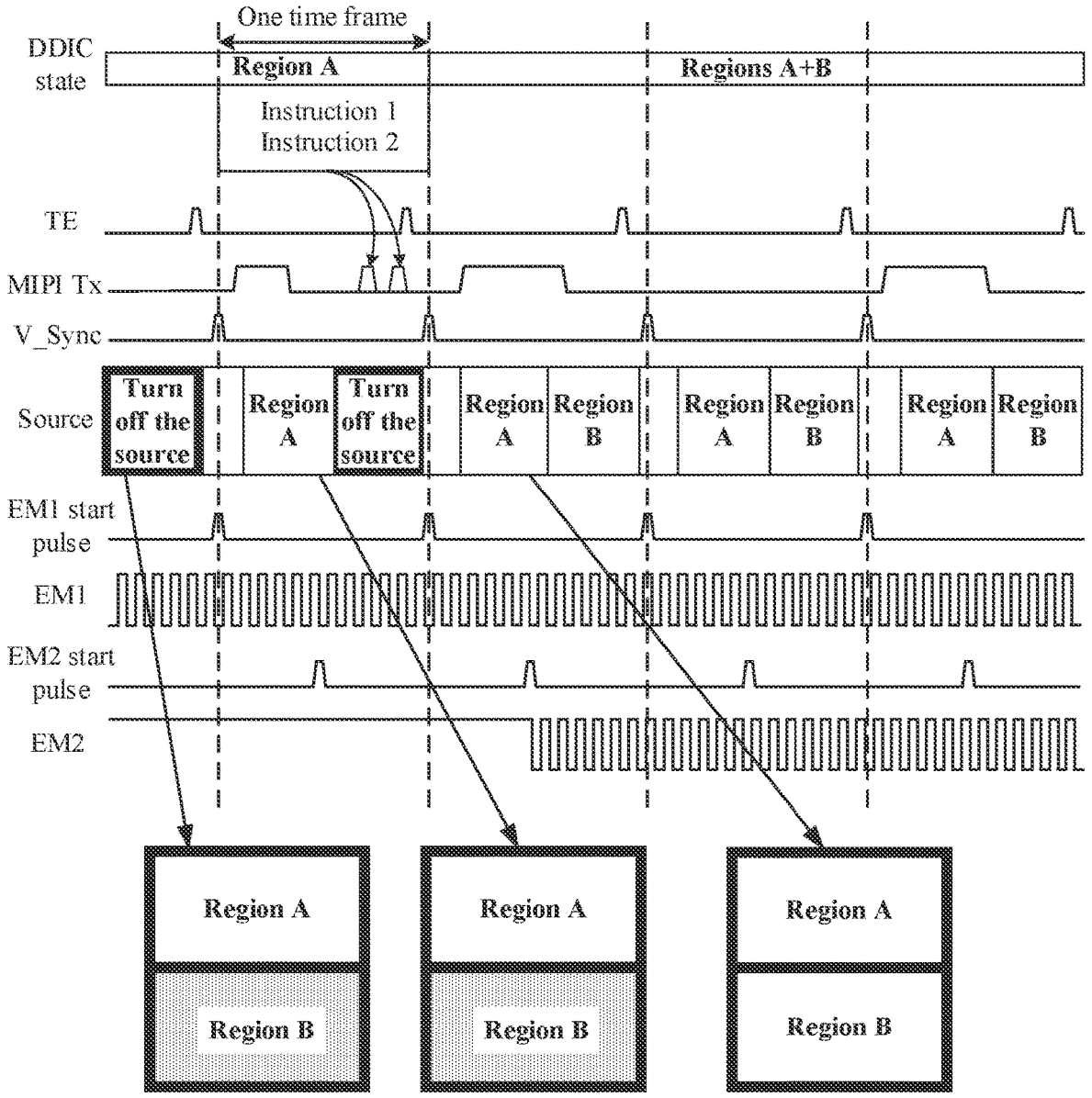
FIG. 19 is a time sequence diagram of switching a display state of a foldable display screen from a region A to regions A+B according to another embodiment of this application.

FIG. 19 is a time sequence diagram of switching a display state of a display screen from a region A to regions A+B according to another embodiment of this application. For definitions and functions of signals in FIG. 19, refer to the foregoing descriptions. Details are not described herein again. As an example rather than a limitation, an instruction 1 in FIG. 19 may be used to indicate the following content:

(1) A DDIC switches to a state of the regions A+B at a next vertical synchronization (V-Sync) moment by receiving a host command that indicates a region mode register update.

(2) Receive, from a host controller, a host command for writing start column and row addresses.

(3) A source channel (source channel) remains in an off state in the region B.

An instruction 2 is used to indicate the following content:

(1) The DDIC reads start column and row addresses at a first pixel of the region A.

(2) A source (source) starts to run normally at a beginning of the region B.

(3) An EM2 starts to run normally.

State switching of the display screen in FIG. 18 and that in FIG. 19 are the same, and both are switching from the region A to the regions A+B. A difference between the two is that the instruction 1 and instruction 2 in the former are separately sent in two time frames, while the instruction 1 and instruction 2 in the latter are sent in a same time frame. Therefore, the latter can implement fast display state switching in one time frame.

Figure 20:
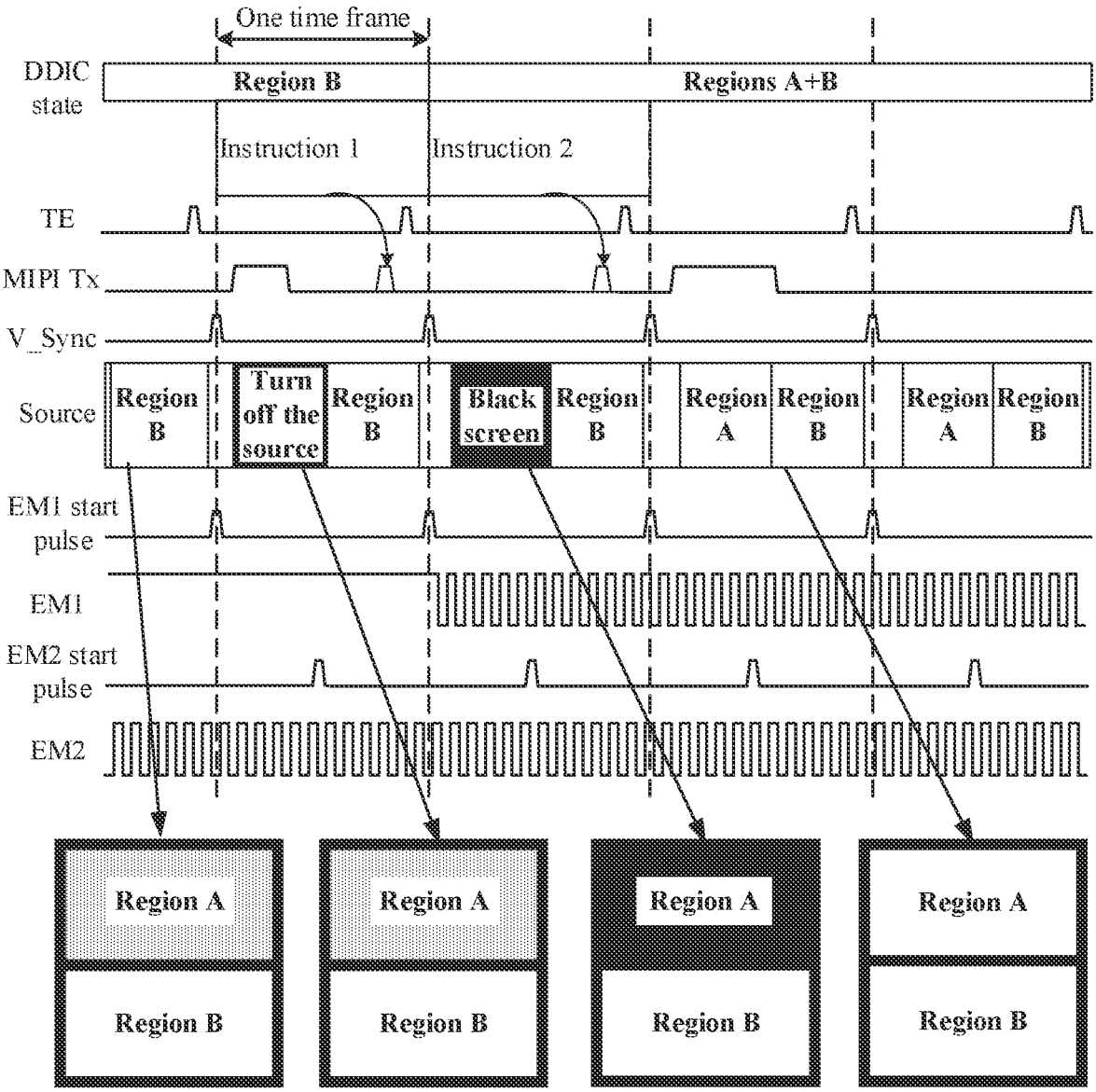
FIG. 20 is a time sequence diagram of switching a display state of a foldable display screen from a region B to regions A+B according to an embodiment of this application.

FIG. 20 is a time sequence diagram of switching a display state of a display screen from a region B to regions A+B according to an embodiment of this application. For definitions and functions of signals in FIG. 20, refer to the foregoing descriptions. Details are not described herein again. As an example rather than a limitation, an instruction 1 in FIG. 20 may be used to indicate the following content:

(1) A DDIC switches to a state of the regions A+B at a next vertical synchronization (V-Sync) moment by receiving a host command that indicates a region mode register update.

(2) A source channel (source channel) remains in an off state in the region A.

An instruction 2 is used to indicate the following content:

(1) The DDIC reads start column and row addresses at a first pixel of the region A.

(2) Receive, from a host controller, a host command for writing the start column and row addresses, where the host command may be supported in a previous or subsequent frame.

(3) A source (source) starts to run normally at a beginning of the region A.

(4) An EM1 starts to run normally.

As shown in FIG. 20, after the instruction 1 and the instruction 2 are received, the EM1 signal changes from a high level to a normal output after passing through an EM1 start pulse, and an EM2 signal remains to be a normal output. The region A switches from a source off state to a black screen state, and then to a normal display state. The region B remains in the normal display state.

Figure 21:
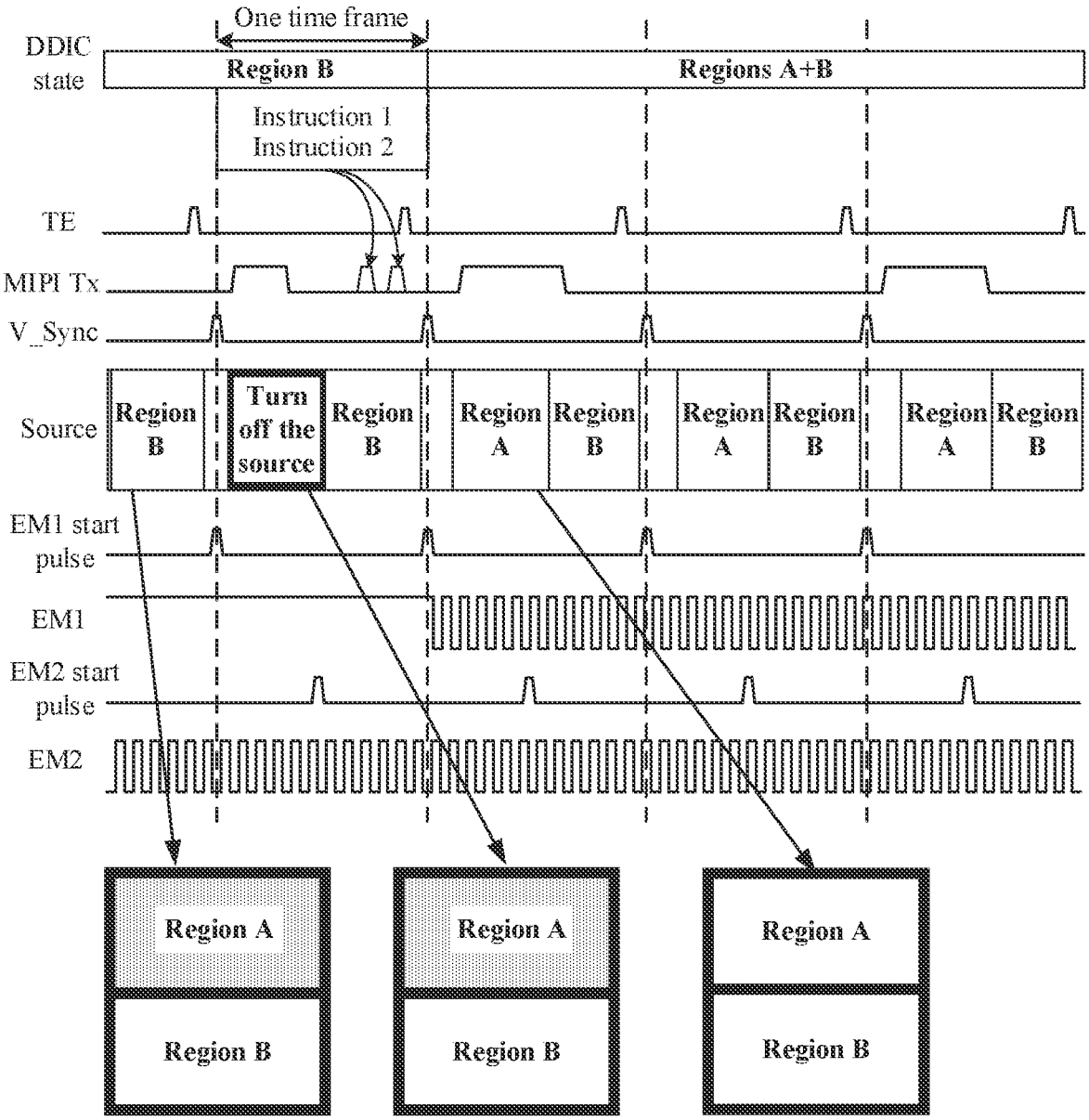
FIG. 21 is a time sequence diagram of switching a display state of a foldable display screen from a region B to regions A+B according to another embodiment of this application.

FIG. 21 is a time sequence diagram of switching a display state of a display screen from a region B to regions A+B according to another embodiment of this application, For definitions and functions of signals in FIG. 21, refer to the foregoing descriptions. Details are not described herein again, As an example rather than a limitation, an instruction 1 in FIG. 21 may be used to indicate the following content:

(1) A DDIC switches to a state of the regions A+B at a next vertical synchronization (V-Sync) moment by receiving a host command that indicates a region mode register update.

(2) Receive, from a host controller, a host command for writing start column and row addresses.

(3) A source channel (source channel) remains in an off state in the region A.

An instruction 2 is used to indicate the following content:

(1) The DDIC reads start column and row addresses at a first pixel of the region A.

(2) A source (source) starts to run normally at a beginning of the region A.

(3) An EM1 signal starts to run normally.

State switching of the display screen in FIG. 20 and that in FIG. 21 are the same, and both are switching from the region B to the regions A+B, A difference between the two is that the instruction 1 and instruction 2 in the former are separately sent in two time frames, while the instruction 1 and instruction 2 in the latter are sent in a same time frame. Therefore, the latter can implement fast display state switching in one time frame.

Figure 22:
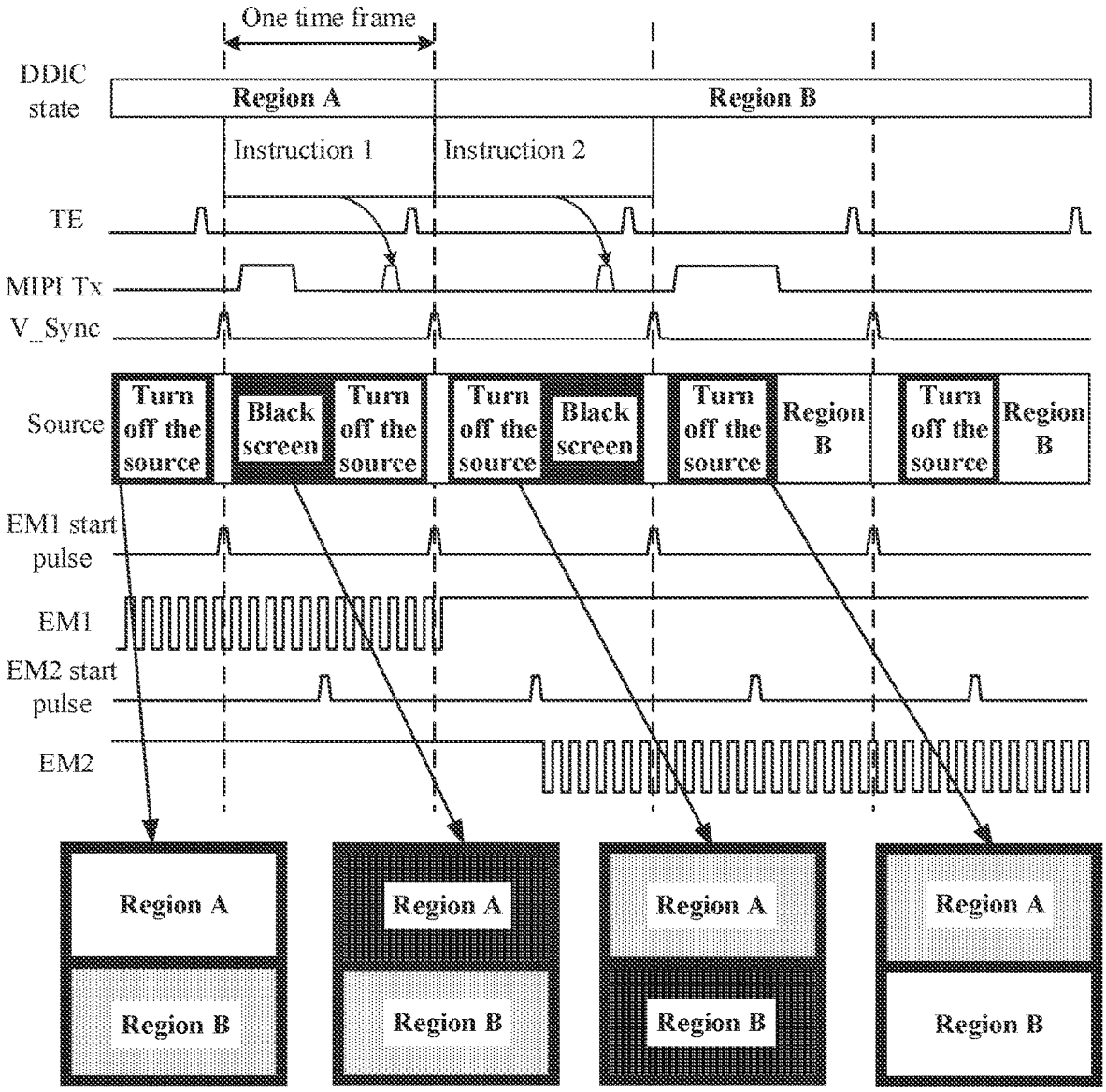
FIG. 22 is a time sequence diagram of switching a display state of a foldable display screen from a region A to a region B according to an embodiment of this application.

FIG. 22 is a time sequence diagram of switching a display state of a display screen from a region A to a region B according to an embodiment of this application. For definitions and functions of signals in FIG. 22, refer to the foregoing descriptions. Details are not described herein again. As an example rather than a limitation, an instruction 1 in FIG. 22 may be used to indicate the following content:

(1) A frame buffer (frame buffer) of the region A writes a black screen image before a source is turned off.

(2) A DDIC switches to a state of the region B at a next vertical synchronization (V-Sync) moment by receiving a host command that indicates a region mode register update.

(3) A source channel remains in an off state in the region B.

(4) A host controller supports sending a black screen image in the region A.

An instruction 2 is used to indicate the following content:

(1) The DDIC reads start column and row addresses at a first pixel of the region B.

(2) Receive, from the host controller, a host command for writing the start column and row addresses, where the host command may be supported in a previous or subsequent frame.

(3) A source (source) starts to run normally at a beginning of the region B.

(4) A source operational amplifier is turned off in the region A.

(5) An EM2 signal starts to run normally.

(6) An EM1 start pulse signal triggers an EM1 signal to be at a high level (H).

As can be seen from FIG. 22, the instruction 1 and the instruction 2 are sent separately in two time frames. After the instruction 1 and the instruction 2 are received, the EM1 signal changes from a normal output to a high level, and the EM2 signal changes from a high level to a normal output. The region A switches from a normal display state to a black screen state, and then to a source off state. The region B switches from the source off state to the black screen state, and then to the normal display state.

Figure 23:
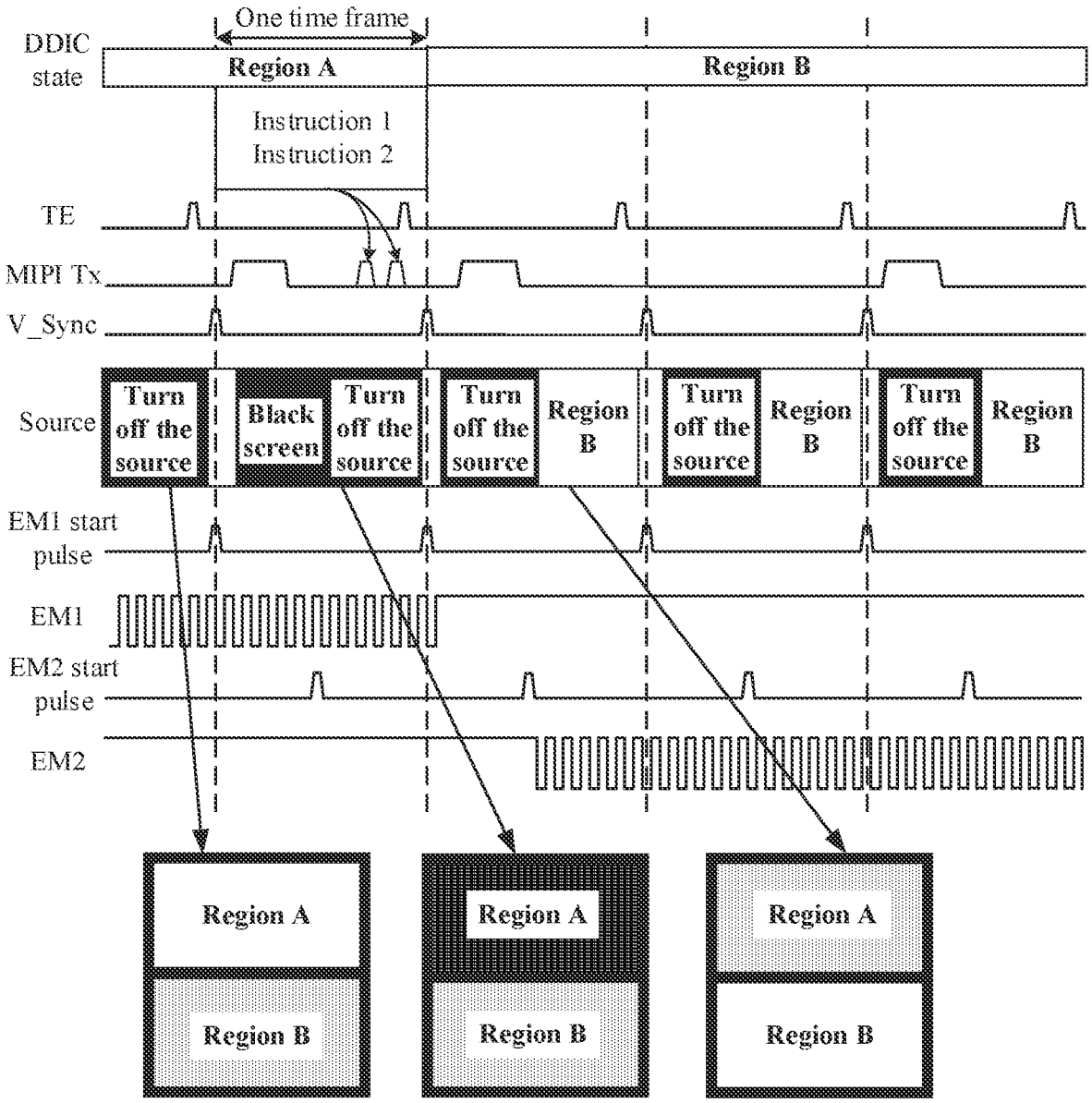
FIG. 23 is a time sequence diagram of switching a display state of a foldable display screen from a region A to a region B according to another embodiment of this application.

FIG. 23 is a time sequence diagram of switching a display state of a display screen from a region A to a region B according to another embodiment of this application. For definitions and functions of signals in FIG. 23, refer to the foregoing descriptions. Details are not described herein again. As an example rather than a limitation, an instruction 1 in FIG. 23 may be used to indicate the following content:

(1) A frame buffer (frame buffer) of the region A writes a black screen image before a source is turned off.

(2) A DDIC switches to a state of the region B at a next vertical synchronization (V-Sync) moment by receiving a host command that indicates a region mode register update.

(3) Receive, from a host controller, a host command for writing start column and row addresses.

(4) A source channel remains in an off state in the region B.

(5) The host controller supports sending a black screen image in the region A.

An instruction 2 is used to indicate the following content:

(1) The DDIC reads start column and row addresses at a first pixel of the region B.

(2) A source (source) starts to run normally at a beginning of the region B.

(3) A source operational amplifier is turned off in the region A.

(4) An EM2 signal starts to run normally.

(5) An EM1 start pulse signal triggers an EM1 signal to be at a high level (H).

As can be seen from FIG. 23, the instruction 1 and the instruction 2 sent by the host controller are sent in a same time frame. Therefore, the display screen can quickly switch the display state in one time frame.

Figure 24:
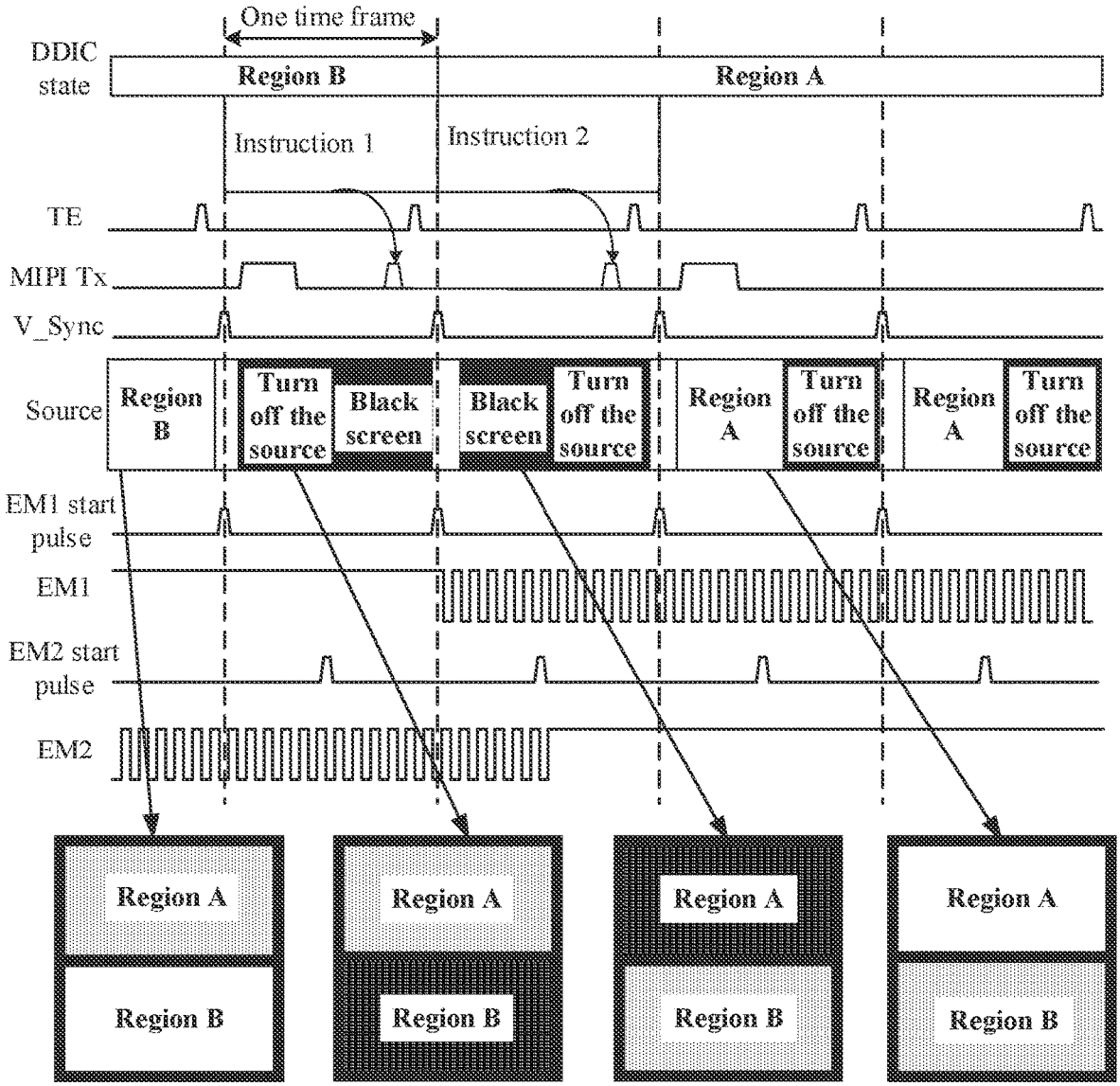
FIG. 24 is a time sequence diagram of switching a display state of a foldable display screen from a region B to a region A according to an embodiment of this application.

FIG. 24 is a time sequence diagram of switching a display state of a display screen from a region B to a region A according to an embodiment of this application. For definitions and functions of signals in FIG. 24, refer to the foregoing descriptions. Details are not described herein again. As an example rather than a limitation, an instruction 1 in FIG. 24 may be used to indicate the following content:

(1) A frame buffer (frame buffer) of the region B writes a black screen image before a source is turned off.

(2) A DDIC switches to a state of the region A at a next vertical synchronization (V-Sync) moment by receiving a host command that indicates a region mode register update.

(3) A source channel remains in an off state in the region A.

(4) A host controller supports sending a black screen image in the region B.

An instruction 2 is used to indicate the following content:

(1) The DDIC reads start column and row addresses at a first pixel of the region A.

(2) Receive, from the host controller, a host command for writing the start column and row addresses, where the host command may be supported in a previous or subsequent frame.

(3) A source (source) starts to run normally at a beginning of the region A.

(4) A source operational amplifier is turned off in the region B.

(5) An EM2 start pulse signal triggers an EM2 signal to be at a high level (H).

(6) An EM1 signal starts to run normally after a start pulse delay.

As shown in FIG. 24, the instruction 1 and the instruction 2 are sent in different time frames. After the instruction 1 and the instruction 2 are received, the EM1 signal changes from a high level to a normal output, and the EM2 signal changes from a normal output to a high level. The region A switches from a source off state to a black screen state, and then to a normal display state. The region B switches from the normal display state to the black screen state, and then to the source off state.

Figure 25:
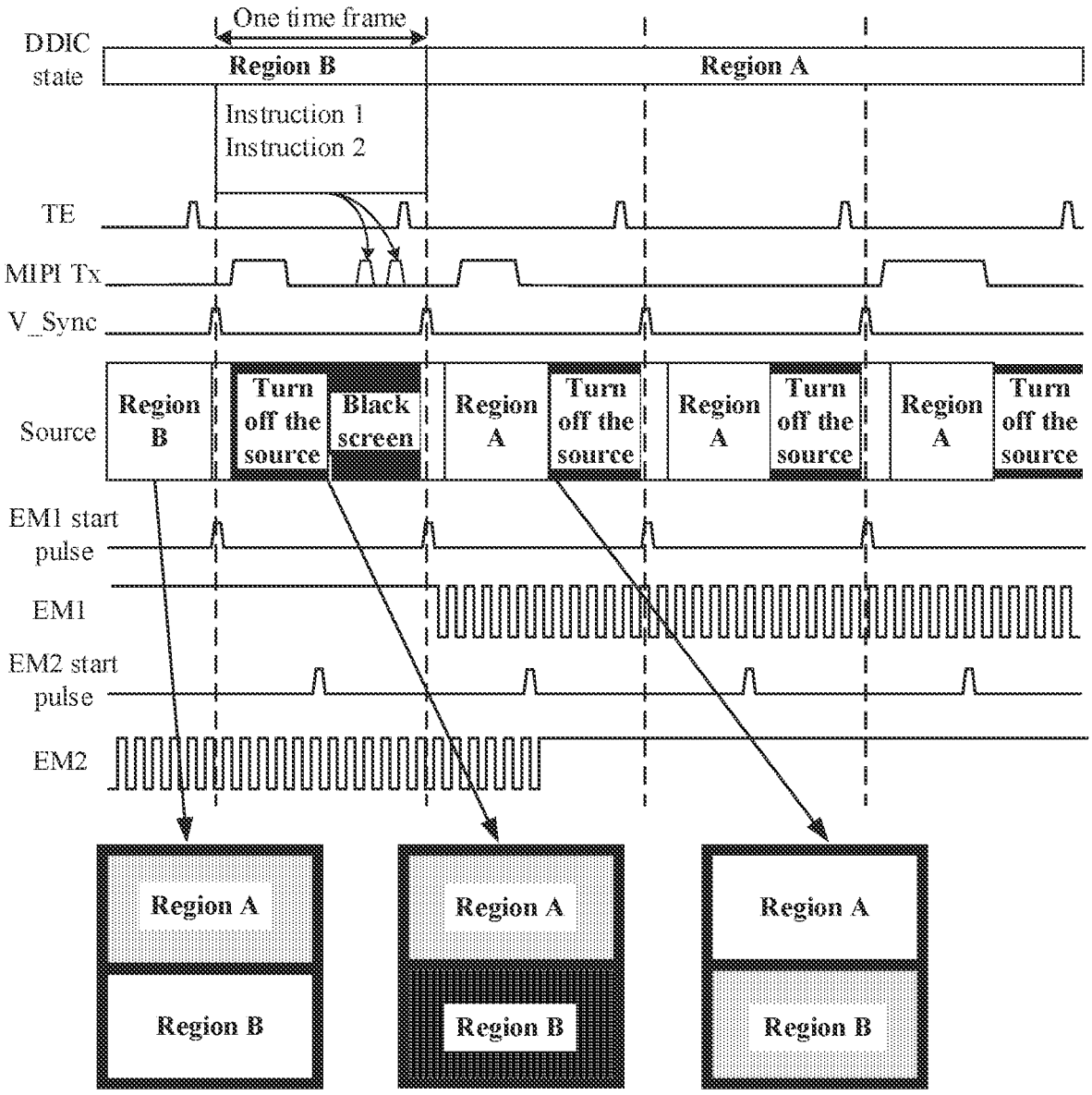
FIG. 25 is a time sequence diagram of switching a display state of a foldable display screen from a region B to a region B according to another embodiment of this application.

FIG. 25 is a time sequence diagram of switching a display state of a display screen from a. region B to a region A according to another embodiment of this application. For definitions and functions of signals in FIG. 25, refer to the foregoing descriptions. Details are not described herein again. As an example rather than a limitation, an instruction 1 in FIG. 25 may be used to indicate the following content:

(1) A frame buffer (frame butler) of the region B writes a black screen image before a source is turned off.

(2) A DDIC switches to a state of the region A at a next vertical synchronization (V-Sync) moment by receiving a host command that indicates a region mode register update.

(3) Receive, from a host controller, a host command for writing start column and row addresses.

(4) A source channel remains in an off state in the region A.

(5) The host controller supports sending a black screen image in the region B.

An instruction 2 may be used to indicate the following content:

(1) The DDIC reads start column and row addresses at a first pixel of the region A.

(2) Receive, from the host controller, a host command for writing the start column and row addresses, where the host command may be supported in a previous or subsequent frame.

(3) A source (source) starts to run normally at a beginning of the region A.

(4) A source operational amplifier is turned off in the region B.

(5) An EM2 start pulse signal triggers an EM2 signal to be at a high level (H).

(6) An EM1 signal starts to run normally after a start pulse delay.

State switching of the display screen in FIG. 24 and that in FIG. 25 are the same, and both are switching from the region B to the region A. A difference between the two is that the instruction 1 and instruction 2 in the termer are separately sent in two time frames, while the instruction 1 and instruction 2 in the latter are sent in a same time frame. Therefore, the latter can implement fast display state switching in one time frame.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of this application.

It may be clearly understood by a person skilled in the art that, for the purpose of convenient and brief description, for a detailed working process of the system, apparatus, and unit described above, refer to a corresponding process in the foregoing method embodiments, and details are not described herein again.

In the several embodiments provided in this application, it should be understood that the disclosed system, apparatus, and method may be implemented in other manners. For example, the described apparatus embodiment is merely an example. For example, the unit division is merely logical function division and may be other division in actual implementation. For example, a plurality of units or components may be combined or integrated into another system, or some features may be ignored or may not be performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected based on actual requirements to achieve the objectives of the solutions of the embodiments.

In addition, functional units in the embodiments of this application may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of this application essentially, or the part contributing to the prior art, or some of the technical solutions may be implemented in a form of a software product. The software product is stored in a storage medium, and includes several instructions for instructing a computer device (which may be a personal computer, a server, a network device, or the like) to perform all or some of the steps of the methods described in the embodiments of this application. The foregoing storage medium includes: any medium that can store program code, such as a USB flash drive, a removable hard disk, a read-only memory (read-only memory, ROM), a random access memory (random access memory, RAM), a magnetic disk, or an optical disc.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. An electronic device comprising:

a display screen comprising:

a first display region; and a second display region; and a display driving system coupled to the display screen and comprising:

a first emission (EM) signal output end configured to send, to the display screen, a first EM signal to control the first display region to display a first image during a first time period;

a second EM signal output end configured to send, to the display screen, a second EM signal to control the second display region to avoid displaying a second image during the first time period;

a video source output end configured to:

output a first video source signal corresponding to the first display region during a first time interval in a first time frame; and turn off a second video source signal corresponding to the second display region during a second time interval in the first time frame, wherein the first time period comprises the first time frame;

a first EM layer positive voltage (ELVDD) output end configured to output a first ELVDD to provide a first high supply voltage for a first pixel circuit in the first display region; and a second ELVDD output end configured to output a second ELVDD to provide a second high supply voltage for a second pixel circuit in the second display region, wherein the first ELVDD and the second ELVDD are different.

2. A display driving system for controlling a display screen, comprising:

a first emission (EM) signal output end configured to send, to the display screen, a first EM signal to control a first display region of the display screen to display a first image during a first time period;

a second EM signal output end configured to send, to the display screen, a second EM signal to control a second display region of the display screen to avoid displaying a second image during the first time period;

a video source output end configured to:

output a first video source signal corresponding to the first display region during a first time interval in a first time frame; and turn off a second video source signal corresponding to the second display region during a second time interval in the first time frame, wherein the first time period comprises the first time frame;

a first EM layer positive voltage (ELVDD) output end configured to output a first ELVDD to provide a first high supply voltage for a first pixel circuit in the first display region; and a second ELVDD output end configured to output a second ELVDD to provide a second high supply voltage for a second pixel circuit in the second display region, wherein the first ELVDD and the second ELVDD are different.

3. The display driving system of claim 2, wherein the first EM signal remains at a first level or transitions between the first level and a second level during the first time period, wherein the second EM signal remains at the second level during the first time period, wherein the first EM signal output end is further configured to send, to the display screen, the first EM signal that is at the first level to control the first display region to emit first light, and wherein the second EM signal output end is further configured to send, to the display screen, the second EM signal that is at the first level to control the second display region to emit second light.

4. The display driving system of claim 2, wherein the video source output end is further configured to:

generate the first video source signal based on a first brightness calibration parameter; and generate the second video source signal based on a second brightness calibration parameter, wherein the first brightness calibration parameter is different from the second brightness calibration parameter.

5. The display driving system of claim 4, wherein each of the first brightness calibration parameter and the second brightness calibration parameter comprises a display brightness vector (DBV).

6. The display driving system of claim 2, further comprising:

a first EM layer negative voltage (ELVSS) output end configured to output a first ELVSS to provide a first low supply voltage for the first pixel circuit; and a second ELVSS output end configured to output a second ELVSS to provide a second low supply voltage for the second pixel circuit, wherein the first ELVSS and the second ELVSS are different.

7. The display driving system of claim 2, further comprising:

a first display drive circuit comprising the first EM signal output end; and a second display drive circuit comprising the second EM signal output end.

8. The display driving system of claim 2, further comprising a first display drive circuit comprising the first EM signal output end and the second EM signal output end.

9. The display driving system of claim 2, wherein the display screen is a foldable display screen.

10. A method comprising:

sending, to a display screen, a first emission (EM) signal and to control a first display region of the display screen to display a first image during a first time period;

sending, to the display screen, a second EM signal to control a second display region of the display screen to avoid displaying a second image during the first time period;

outputting, to the display screen during a first time interval in a first time frame, a first video source signal corresponding to the first display region;

turning off a second video source signal corresponding to the second display region during a second time interval in the first time frame, wherein the first time period comprises the first time frame;

outputting, to the display screen, a first EM layer positive voltage (ELVDD) to provide a first high supply voltage for a first pixel circuit in the first display region; and outputting, to the display screen, a second ELVDD to provide a second high supply voltage for a second pixel circuit in the second display region, wherein the first ELVDD and the second ELVDD are different.

11. The method of claim 10, wherein the first EM signal remains at a first level or transitions between the first level and a second level during the first time period, wherein the second EM signal remains at the second level during the first time period, and wherein the method further comprises:

sending, to the display screen, the first EM signal that is at the first level to control the first display region to emit first light; and sending, to the display screen, the second EM signal that is at the first level to control the second display region to emit second light.

12. The method of claim 10, further comprising:

outputting, to the display screen during a first time interval in a second time frame, a third video source signal corresponding to the first display region and indicating a black screen, wherein the second time frame is adjacent to a third time frame and is located before the third time frame; and further sending, to the display screen, the first EM signal to control, starting from the third time frame, the first display region to switch from displaying the first image to avoid displaying the first image.

13. The method of claim 10, further comprising:

outputting, to the display screen during a first time interval in a fourth time frame, a fourth video source signal corresponding to the first display region and indicating a black screen, wherein the fourth time frame is adjacent to a fifth time frame and is located before the fifth time frame; and further sending, to the display screen, the first EM signal to control, starting from the fourth time frame, the first display region to switch from not displaying the first image to displaying the first image.

14. The method of claim 10, further comprising:

generating the first video source signal based on a first brightness calibration parameter; and generating the second video source signal based on a second brightness calibration parameter, wherein the first brightness calibration parameter and the second brightness calibration parameter are different.

15. The method of claim 14, wherein each of the first brightness calibration parameter and the second brightness calibration parameter comprises a display brightness vector (DBV).

16. The method of claim 10, further comprising:

outputting, to the display screen, a first EM layer negative voltage (ELVSS) to provide a first low supply voltage for the first pixel circuit; and outputting, to the display screen, a second ELVSS to provide a second low supply voltage for the second pixel circuit, wherein the first ELVSS and the second ELVSS are different.

17. The method of claim 10, wherein the display screen is a foldable display screen.

18. The display driving system of claim 2, wherein the first EM signal remains at a first level or transitions between the first level and a second level during the first time period, wherein the second EM signal remains at the second level during the first time period, wherein the first EM signal output end is further configured to send, to the display screen, the first EM signal that is at the second level to control the first display region to not to emit first light, and wherein the second EM signal output end is further configured to send, to the display screen, the second EM signal that is at the second level to control the second display region to not to emit second light.

19. The display driving system of claim 2, wherein the video source output end is further configured to output, to the display screen during a first time interval in a second time frame, a third video source signal corresponding to the first display region and indicating a black screen, wherein the second time frame is adjacent to a third time frame and is located before the third time frame, and wherein the first EM signal output end is further configured to further send, to the display screen, the first EM signal to control, starting from the third time frame, the first display region to switch from displaying the first image to avoid displaying the first image.

20. The method of claim 10, wherein the first EM signal remains at a first level or transitions between the first level and a second level during the first time period, wherein the second EM signal remains at the second level during the first time period, and wherein the method further comprises:

sending, to the display screen, the first EM signal that is at the second level to control the first display region to not to emit first light; and sending, to the display screen, the second EM signal that is at the second level to control the second display region to not to emit second light.

* * * * *